US008088204B2

(12) United States Patent
Taylor et al.

(10) Patent No.: US 8,088,204 B2
(45) Date of Patent: Jan. 3, 2012

(54) SYNERGISTIC COMBINATIONS OF CHROMATE-FREE CORROSION INHIBITORS

(76) Inventors: S. Ray Taylor, Houston, TX (US); Brian Chambers, Jackson, MS (US)

( * ) Notice: Subject to any disclaimer, the term of this patent is extended or adjusted under 35 U.S.C. 154(b) by 0 days.

(21) Appl. No.: 11/817,659

(22) PCT Filed: Mar. 1, 2006

(86) PCT No.: PCT/US2006/007305

§ 371 (c)(1),
(2), (4) Date: Sep. 9, 2008

(87) PCT Pub. No.: WO2007/084150

PCT Pub. Date: Jul. 26, 2007

(65) Prior Publication Data

US 2009/0000958 A1 Jan. 1, 2009

Related U.S. Application Data

(60) Provisional application No. 60/657,298, filed on Mar. 1, 2005.

(51) Int. Cl.
*C09D 5/08* (2006.01)
*C23F 11/00* (2006.01)
*B05D 1/36* (2006.01)

(52) U.S. Cl. ..... 106/14.05; 252/387; 427/402; 427/419.1

(58) Field of Classification Search ..... 106/14.05; 252/387, 389.2, 389.4, 389.62; 427/419.1, 427/402; 428/469, 472
See application file for complete search history.

(56) References Cited

U.S. PATENT DOCUMENTS

| | | | | |
|---|---|---|---|---|
| 4,082,626 | A * | 4/1978 | Hradcovsky | 205/106 |
| 4,264,378 | A * | 4/1981 | Oppen et al. | 148/261 |
| 4,963,290 | A * | 10/1990 | Bressan et al. | 252/387 |
| 5,059,640 | A | 10/1991 | Hegedus et al. | |
| 5,322,560 | A | 6/1994 | DePue et al. | |
| 5,399,210 | A * | 3/1995 | Miller | 148/273 |
| 5,445,748 | A * | 8/1995 | Holinski | 508/129 |
| 5,730,796 | A * | 3/1998 | Brand et al. | 106/446 |
| 5,954,893 | A | 9/1999 | Baldwin et al. | |
| 6,464,772 | B1 * | 10/2002 | Vermoortele et al. | 106/479 |
| 6,537,678 | B1 | 3/2003 | Putnam et al. | |
| 6,758,887 | B2 | 7/2004 | Bhatia et al. | |
| 2004/0020568 | A1 * | 2/2004 | Phelps et al. | 148/273 |
| 2004/0104377 | A1 | 6/2004 | Phelps et al. | |
| 2004/0262580 | A1 | 12/2004 | Yu et al. | |

FOREIGN PATENT DOCUMENTS

| | | | |
|---|---|---|---|
| WO | 2004085551 | A1 | 10/2004 |
| WO | 2007084150 | A1 | 7/2007 |

OTHER PUBLICATIONS

Derwent-Acc-No. 2005-152763, abstract of Chinese Patent Specification No. CN 1539908A (Oct. 2004).*

Taylor, et al.; Identification and Characterization of Nonchromate Corrosion Inhibitor Synergies Using High-Throughput Methods; Corrosion; 2008; 64(3); pp. 255-270.

Chambers, et al.; The Rapid Discovery of Synergistic Combinations of Corrosion Inhibitors Using High Throughput Screening Methods; Corrosion, 2005, 61(5), pp. 480-489.

Taylor, et al.; The Discovery of Non-Chromate Corrosion Inhibitors for Aerospace Alloys Using High-Throughput Screening Methods; Corrosion, 2007, 25 (5-6), pp. 571-591.

Chambers, et al.; High-Throughput Assessment of Inhibitor Synergies on Aluminum Alloy 2024-T3 Through Measurement of Surface Copper Enrichment; Corrosion, 2007, 63(3), pp. 268-276.

Chambers, et al.; The high throughput assessment of aluminium alloy corrosion using fluorometric methods. Part I—Development of a fluorometric method to quantify aluminium ion concentration; Corrosion, 2007, pp. 1584-1596.

Chambers, et al.; The high throughput assessment of aluminium alloy corrosion using fluorometric methods. Part II—A combinatorial study of corrosion inhibitors and synergistic combinations; Corrosion, 2007, pp. 1597-1609.

Chambers, et al.; Multiple Electrode Methods to Massively Parallel Test Corrosion Inhibitors for AA2024-T3; Corrosion NACExpo 2006, pp. 1-21.

Taylor, et al.; The Discovery of Non-Chromate Corrosion Inhibitors for Aerospace Alloys Using High-Throughput Screening Methods, Aluminium Surface Science and Technology (Asst 2006) Proceedings, 45, pp. 418-424.

* cited by examiner

*Primary Examiner* — Anthony Green
(74) *Attorney, Agent, or Firm* — Stites & Harbison PLLC; Richard S. Myers, Jr.; Nicolo Davidson

(57) ABSTRACT

An anti-corrosive composition, comprising a combination of at least two of the following materials: vanadates, molybdates, tungstates, silicates, phosphates, borates, Ce cations, Y cations, La cations, Eu cations, Gd cations, Nd cations, and reaction products thereof.

3 Claims, 24 Drawing Sheets

Figure 1. Metallography of 2024 sheet[34] (top left and right), cross-section of 2024 wire (bottom right), longitudinal cross-section of 2024 wire (bottom left); (images to scale)

Figure 2. Schematic of two-electrode array of AA2024 wires and reaction frame

Figure 3. Corrosion resistance versus time as determined by EIS of AA2024-T3 sheet in 3.4 mM inhibitor + 0.6 M NaCl solution adjusted to pH 7.[8,26]

Figure 4. Example MMA output – $I_{2024/2024}$ – 100 mV bias of AA2024 electrodes exposed to 3.4 mM $Na_3PO_4$ in 0.6 M NaCl solution adjusted to pH 7

Figure 5. Comparison of inhibitor performance in EIS and 100 mV DC bias rapid screening for 11 different chemistries

Figure 6. Plot of current of 3.4 mM $KH_2PO_4/YCl_3$, 0.6 M NaCl (pH 7)

Figure 7. Plot of current of 3.4 mM $Na_2SiO_3/YCl_3$, 0.6 M NaCl (pH 7)

Figure 8. Plot of current of 3.4 mM $NaVO_3/CeCl_3$, 0.6 M NaCl (pH 7)

Figure 9. Plot of current of 3.4 mM $NaVO_3/Na_3PO_4$, 0.6 M NaCl (pH 7)

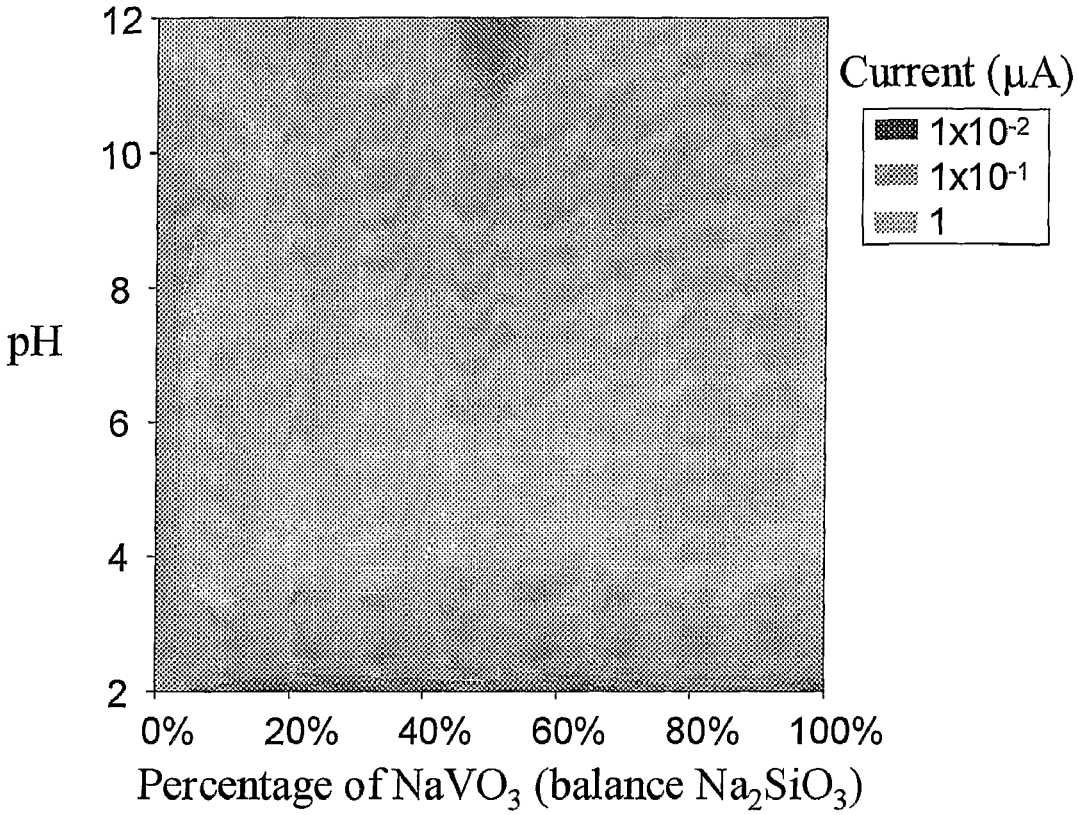
Figure 11. Current from MMA testing of 3.4 mM $NaVO_3/Na_2SiO_3$ varying pH 2-12.

| Inhibitor A | Inhibitor B | Percentage Points Exhibiting Synergy | Percentage Points Exhibiting Antagonism | All Mixture Currents Less than Control? | Percentage Points with Currents Under $5x\ 10^{-8}$ A | Percentage Points with Currents Under $1x\ 10^{-7}$ A | Behavior Observed |
|---|---|---|---|---|---|---|---|
| NaVO3 | BaB2O4 | 57.1% | 0.0% | yes | 42.9% | 100.0% | Synergy |
| NaVO3 | CeCl3 | 0.0% | 85.7% | yes | 0.0% | 85.7% | Antagonism |
| NaVO3 | YCl3 | 28.6% | 28.6% | yes | 14.3% | 71.4% | Synergy and Antagonism |
| NaVO3 | NaWO4-3WO3 | 57.1% | 0.0% | no | 57.1% | 85.7% | Synergy |
| NaVO3 | KH2PO4 | 14.3% | 0.0% | yes | 0.0% | 100.0% | Lack of Benefit |
| NaVO3 | LaCl3 | 28.6% | 42.9% | yes | 28.6% | 85.7% | Synergy and Antagonism |
| NaVO3 | Na2SiO3 | 28.6% | 0.0% | yes | 28.6% | 100.0% | Mild Synergy |
| NaVO3 | Na3PO4 | 0.0% | 0.0% | yes | 0.0% | 85.7% | Lack of Benefit |
| NaVO3 | Na2MoO4 | 71.4% | 0.0% | yes | 71.4% | 85.7% | Synergy |
| BaB2O4 | CeCl3 | 71.4% | 0.0% | yes | 71.4% | 71.4% | Synergy |
| BaB2O4 | YCl3 | 100.0% | 0.0% | yes | 42.9% | 100.0% | Synergy |
| BaB2O4 | NaWO4-3WO3 | 28.6% | 14.3% | no | 0.0% | 0.0% | Synergy and Antagonism |
| BaB2O4 | KH2PO4 | 0.0% | 0.0% | yes | 0.0% | 0.0% | Lack of Benefit |
| BaB2O4 | LaCl3 | 85.7% | 0.0% | yes | 71.4% | 100.0% | Synergy |
| BaB2O4 | Na2SiO3 | 28.6% | 14.3% | yes | 0.0% | 14.3% | Synergy and Antagonism |
| BaB2O4 | Na3PO4 | 0.0% | 14.3% | yes | 0.0% | 0.0% | Mild Antagonism |
| BaB2O4 | Na2MoO4 | 0.0% | 0.0% | yes | 0.0% | 0.0% | Lack of Benefit |
| CeCl3 | YCl3 | 28.6% | 0.0% | yes | 57.1% | 100.0% | Mild Synergy |
| CeCl3 | NaWO4-3WO3 | 71.4% | 0.0% | yes | 71.4% | 85.7% | Synergy |
| CeCl3 | KH2PO4 | 0.0% | 42.9% | no | 0.0% | 42.9% | Antagonism |
| CeCl3 | LaCl3 | 14.3% | 28.6% | yes | 42.9% | 100.0% | Synergy and Antagonism |
| CeCl3 | Na2SiO3 | 57.1% | 0.0% | yes | 57.1% | 100.0% | Synergy |
| CeCl3 | Na3PO4 | 0.0% | 57.1% | no | 0.0% | 42.9% | Antagonism |
| CeCl3 | Na2MoO4 | 85.7% | 0.0% | yes | 85.7% | 85.7% | Synergy |
| YCl3 | NaWO4-3WO3 | 85.7% | 0.0% | yes | 85.7% | 85.7% | Synergy |
| YCl3 | KH2PO4 | 28.6% | 28.6% | no | 0.0% | 28.6% | Synergy and Antagonism |
| YCl3 | LaCl3 | 0.0% | 100.0% | yes | 0.0% | 0.0% | Antagonism |
| YCl3 | Na2SiO3 | 100.0% | 0.0% | yes | 71.4% | 100.0% | Synergy |
| YCl3 | Na3PO4 | 28.6% | 57.1% | no | 0.0% | 28.6% | Synergy and Antagonism |
| YCl3 | Na2MoO4 | 100.0% | 0.0% | yes | 100.0% | 100.0% | Synergy |
| NaWO4-3WO3 | KH2PO4 | 85.7% | 0.0% | yes | 0.0% | 0.0% | Synergy |
| NaWO4-3WO3 | LaCl3 | 85.7% | 0.0% | yes | 28.6% | 85.7% | Synergy |
| NaWO4-3WO3 | Na2SiO3 | 85.7% | 0.0% | yes | 0.0% | 71.4% | Synergy |
| NaWO4-3WO3 | Na3PO4 | 0.0% | 71.4% | no | 0.0% | 0.0% | Antagonism |
| NaWO4-3WO3 | Na2MoO4 | 28.6% | 71.4% | no | 0.0% | 0.0% | Synergy and Antagonism |
| KH2PO4 | LaCl3 | 28.6% | 28.6% | no | 14.3% | 28.6% | Synergy and Antagonism |
| KH2PO4 | Na2SiO3 | 0.0% | 0.0% | yes | 0.0% | 0.0% | Lack of Benefit |
| KH2PO4 | Na2MoO4 | 42.9% | 42.9% | no | 0.0% | 0.0% | Synergy and Antagonism |
| LaCl3 | Na2SiO3 | 71.4% | 0.0% | yes | 71.4% | 100.0% | Synergy |
| LaCl3 | Na3PO4 | 28.6% | 57.1% | no | 14.3% | 28.6% | Synergy and Antagonism |
| LaCl3 | Na2MoO4 | 100.0% | 0.0% | yes | 100.0% | 100.0% | Synergy |
| Na2SiO3 | Na3PO4 | 28.6% | 0.0% | yes | 0.0% | 0.0% | Mild Synergy |
| Na2SiO3 | Na2MoO4 | 42.9% | 0.0% | yes | 0.0% | 0.0% | Mild Synergy |
| Na3PO4 | Na2MoO4 | 85.7% | 0.0% | yes | 0.0% | 0.0% | Synergy |

Figure 12. Chart of Synergy Behavior based on Peak 1 Values from Cyclic Voltammetry Testing (24 hour exposure)

| | | 100 mV Polarization between AA2024 electrodes Testing method | | | | | Peak 1 Values of Cyclic Voltammetry after 24 hour exposure | | | | | |
|---|---|---|---|---|---|---|---|---|---|---|---|---|
| Inhibitor A | Inhibitor B | Behavior Observed | Percentage Points Exhibiting Synergy | Percentage Points Exhibiting Antagonism | All Mixture Currents Less than Control? | Percentage Points with Currents Under 0.6 microamps | Percentage Points Exhibiting Synergy | Percentage Points Exhibiting Antagonism | All Mixture Currents Less than Control? | Percentage Points with Currents Under $5x\ 10^{-6}$ A | Percentage Points with Currents Under $1x\ 10^{-7}$ A | Behavior Observed |
| NaVO3 | BaB2O4 | Mild Synergy | 14.3% | 0.0% | yes | 14.3% | 57.1% | 0.0% | yes | 42.9% | 100.0% | Synergy |
| NaVO3 | CeCl3 | Antagonism | 0.0% | 100.0% | yes | 0.0% | 0.0% | 85.7% | yes | 0.0% | 85.7% | Antagonism |
| NaVO3 | YCl3 | Synergy | 61.5% | 0.0% | yes | 53.8% | 28.6% | 28.6% | yes | 14.3% | 71.4% | Synergy and Antagonism |
| NaVO3 | NaWO4-3WO3 | Lack of Benefit | 0.0% | 0.0% | yes | 0.0% | 57.1% | 0.0% | no | 57.1% | 85.7% | Synergy |
| NaVO3 | KH2PO4 | Lack of Benefit | 0.0% | 0.0% | yes | 0.0% | 14.3% | 0.0% | yes | 0.0% | 100.0% | Lack of Benefit |
| NaVO3 | LaCl3 | Antagonism | 0.0% | 100.0% | yes | 0.0% | 28.6% | 42.9% | yes | 28.6% | 85.7% | Synergy and Antagonism |
| NaVO3 | Na2SiO3 | Synergy | 100.0% | 0.0% | yes | 100.0% | 28.6% | 0.0% | yes | 28.6% | 100.0% | Mild Synergy |
| NaVO3 | Na3PO4 | Synergy | 100.0% | 0.0% | yes | 100.0% | 0.0% | 0.0% | yes | 0.0% | 85.7% | Lack of Benefit |
| NaVO3 | Na2MoO4 | Synergy | 100.0% | 0.0% | yes | 100.0% | 71.4% | 0.0% | yes | 71.4% | 85.7% | Synergy |
| BaB2O4 | CeCl3 | Mild Synergy | 42.9% | 0.0% | no | 42.9% | 71.4% | 0.0% | yes | 71.4% | 71.4% | Synergy |
| BaB2O4 | YCl3 | Synergy | 71.4% | 0.0% | no | 0.0% | 100.0% | 0.0% | yes | 42.9% | 100.0% | Synergy |
| BaB2O4 | NaWO4-3WO3 | Synergy and Antagonism | 28.6% | 28.6% | no | 0.0% | 28.6% | 14.3% | no | 0.0% | 0.0% | Synergy and Antagonism |
| BaB2O4 | KH2PO4 | Antagonism | 0.0% | 71.4% | no | 0.0% | 0.0% | 0.0% | yes | 0.0% | 0.0% | Lack of Benefit |
| BaB2O4 | LaCl3 | Mild Synergy | 14.3% | 0.0% | no | 14.3% | 85.7% | 0.0% | yes | 71.4% | 100.0% | Synergy |
| BaB2O4 | Na2SiO3 | Lack of Benefit | 0.0% | 0.0% | no | 0.0% | 28.6% | 14.3% | yes | 0.0% | 14.3% | Synergy and Antagonism |
| BaB2O4 | Na3PO4 | Synergy and Antagonism | 14.3% | 71.4% | no | 0.0% | 0.0% | 14.3% | yes | 0.0% | 0.0% | Mild Antagonism |
| BaB2O4 | Na2MoO4 | Mild Antagonism | 0.0% | 42.9% | no | 0.0% | 0.0% | 0.0% | yes | 0.0% | 0.0% | Lack of Benefit |
| CeCl3 | YCl3 | Synergy and Antagonism | 28.6% | 28.6% | no | 0.0% | 28.6% | 0.0% | yes | 57.1% | 100.0% | Mild Synergy |
| CeCl3 | NaWO4-3WO3 | Mild Synergy | 28.6% | 0.0% | no | 0.0% | 71.4% | 0.0% | yes | 71.4% | 85.7% | Synergy |
| CeCl3 | KH2PO4 | Synergy and Antagonism | 14.3% | 14.3% | no | 0.0% | 0.0% | 42.9% | no | 0.0% | 42.9% | Antagonism |
| CeCl3 | LaCl3 | Synergy and Antagonism | 42.9% | 14.3% | yes | 71.4% | 14.3% | 28.6% | yes | 42.9% | 100.0% | Synergy and Antagonism |
| CeCl3 | Na2SiO3 | Synergy | 71.4% | 0.0% | yes | 57.1% | 57.1% | 0.0% | yes | 57.1% | 100.0% | Synergy |
| CeCl3 | Na3PO4 | Mild Synergy | 28.6% | 0.0% | no | 14.3% | 0.0% | 57.1% | no | 0.0% | 42.9% | Antagonism |
| CeCl3 | Na2MoO4 | Synergy and Antagonism | 28.6% | 28.6% | no | 28.6% | 85.7% | 0.0% | yes | 85.7% | 85.7% | Synergy |
| YCl3 | NaWO4-3WO3 | Mild Synergy | 14.3% | 0.0% | no | 0.0% | 85.7% | 0.0% | yes | 85.7% | 85.7% | Synergy |
| YCl3 | KH2PO4 | Lack of Benefit | 0.0% | 0.0% | no | 0.0% | 28.6% | 28.6% | no | 0.0% | 28.6% | Synergy and Antagonism |
| YCl3 | LaCl3 | Lack of Benefit | 0.0% | 0.0% | yes | 0.0% | 0.0% | 100.0% | yes | 0.0% | 0.0% | Antagonism |
| YCl3 | Na2SiO3 | Synergy and Antagonsim | 57.1% | 28.6% | no | 14.3% | 100.0% | 0.0% | yes | 71.4% | 100.0% | Synergy |
| YCl3 | Na3PO4 | Synergy and Antagonism | 14.3% | 42.9% | no | 0.0% | 28.6% | 57.1% | no | 0.0% | 28.6% | Synergy and Antagonism |
| YCl3 | Na2MoO4 | Synergy and Antagonism | 28.6% | 57.1% | no | 14.3% | 100.0% | 0.0% | yes | 100.0% | 100.0% | Synergy |
| NaWO4-3WO3 | KH2PO4 | Synergy and Antagonism | 14.3% | 14.3% | no | 0.0% | 85.7% | 0.0% | yes | 0.0% | 0.0% | Synergy |
| NaWO4-3WO3 | LaCl3 | Lack of Benefit | 0.0% | 0.0% | no | 0.0% | 85.7% | 0.0% | yes | 28.6% | 85.7% | Synergy |
| NaWO4-3WO3 | Na2SiO3 | Mild Antagonism | 0.0% | 14.3% | no | 0.0% | 85.7% | 0.0% | yes | 0.0% | 71.4% | Synergy |
| NaWO4-3WO3 | Na3PO4 | Lack of Benefit | 0.0% | 0.0% | no | 0.0% | 0.0% | 71.4% | no | 0.0% | 0.0% | Antagonism |
| NaWO4-3WO3 | Na2MoO4 | Lack of Benefit | 0.0% | 0.0% | no | 0.0% | 28.6% | 71.4% | no | 0.0% | 0.0% | Synergy and Antagonism |
| KH2PO4 | LaCl3 | Synergy and Antagonism | 28.6% | 14.3% | no | 28.6% | 28.6% | 28.6% | no | 14.3% | 28.6% | Synergy and Antagonism |
| KH2PO4 | Na2SiO3 | Synergy and Antagonism | 14.3% | 85.7% | no | 0.0% | 0.0% | 0.0% | yes | 0.0% | 0.0% | Lack of Benefit |
| KH2PO4 | Na2MoO4 | Synergy and Antagonism | 28.6% | 28.6% | no | 0.0% | 42.9% | 42.9% | no | 0.0% | 0.0% | Synergy and Antagonism |
| LaCl3 | Na2SiO3 | Mild Synergy | 42.9% | 0.0% | no | 42.9% | 71.4% | 0.0% | yes | 71.4% | 100.0% | Synergy |
| LaCl3 | Na3PO4 | Mild Antagonism | 0.0% | 42.9% | no | 0.0% | 28.6% | 57.1% | no | 14.3% | 28.6% | Synergy and Antagonism |
| LaCl3 | Na2MoO4 | Synergy and Antagonism | 28.6% | 28.6% | no | 28.6% | 100.0% | 0.0% | yes | 100.0% | 100.0% | Synergy |
| Na2SiO3 | Na3PO4 | Synergy | 71.4% | 0.0% | no | 0.0% | 28.6% | 0.0% | yes | 0.0% | 0.0% | Mild Synergy |
| Na2SiO3 | Na2MoO4 | Antagonism | 0.0% | 85.7% | no | 0.0% | 42.9% | 0.0% | yes | 0.0% | 0.0% | Mild Synergy |
| Na3PO4 | Na2MoO4 | Synergy and Antagonism | 42.9% | 14.3% | no | 0.0% | 85.7% | 0.0% | yes | 0.0% | 0.0% | Synergy |

Figure 13

Figure 18. Schematic of Cells used for exposure of AA2024-T3 wire to 3.4 mM total inhibitor, 0.6 M NaCl (left) and for cyclic voltammetry of corroded AA2024-T3 in borate buffer using common counter and reference electrodes (right)

AA2024-T3 exposed to 3.4 mM total $CeCl_3$ + $NaVO_3$ in 0.6 M NaCl for 24 hours
Sequenced exposure - AA2024-T3 immersed in $CeCl_3$ (A) in 0.6 M NaCl for 24 hours, then moved to $NaVO_3$ (B) on 0.6 M NaCl solution for 24 hours. A + B = 3.4 mM AA2024-T3 exposed to 3.4 mM total $LaCl_3$ + $Na_2MoO_4$ in 0.6 M NaCl for 24 hours Sequenced exposure - AA2024-T3 immersed in $LaCl_3$ (A) in 0.6 M NaCl for 24 hours, then moved to $Na_2MoO_4$ (B) on 0.6 M NaCl solution for 24 hours. A + B = 3.4 mM AA2024-T3 exposed to 3.4 mM total $CeCl_3$ + $NaVO_3$ in 0.6 M NaCl for 24 hours
Sequenced exposure - AA2024-T3 immersed in $CeCl_3$ (A) in 0.6 M NaCl for 24 hours, then moved to $NaVO_3$ (B) on 0.6 M NaCl solution for 24 hours. A + B = 3.4 mM AA2024-T3 exposed to 3.4 mM total $LaCl_3$ + $Na_2MoO_4$ in 0.6 M NaCl for 24 hours
Sequenced exposure - AA2024-T3 immersed in $LaCl_3$ (A) in 0.6 M NaCl for 24 hours, then moved to $Na_2MoO_4$ (B) on 0.6 M NaCl solution for 24 hours. A + B = 3.4 mM AA2024-T3 exposed to 3.4 mM total $CeCl_3$ + $NaVO_3$ in 0.6 M NaCl for 24 hours Sequenced exposure - AA2024-T3 immersed in $CeCl_3$ (A) in 0.6 M NaCl for 24 hours, then moved to $NaVO_3$ (B) on 0.6 M NaCl solution for 24 hours. A + B = 3.4 mM AA2024-T3 exposed to 3.4 mM total $CeCl_3$ + $NaVO_3$ in 0.6 M NaCl for 24 hours
Sequenced exposure - AA2024-T3 immersed in $CeCl_3$ (A) in 0.6 M NaCl for 24 hours, then moved to $NaVO_3$ (B) on 0.6 M NaCl solution for 24 hours. A + B = 3.4 mM

SYNERGISTIC COMBINATIONS OF CHROMATE-FREE CORROSION INHIBITORS

Cross reference to related applications

This application is a 371 US National Stage Application of International Application PCT/US06/07305, filed on Mar. 1, 2006, which claims priority to US provisional application 60/657,298, filed on Mar. 1, 2005, the contents of which are hereby incorporated by reference herein in their entirety.

GOVERNMENT SUPPORT

This invention was made with assistance from the Department of Defense Subcontract No. GG10306-120476 and Air Force Office of Scientific Research Contract Number F49620-01-1-0352. The United States Government may have rights to the present invention.

FIELD OF THE INVENTION

The present invention generally relates to the field of corrosion inhibitors. More specifically, embodiments of the present invention relate to synergistic combinations of vanadates, molybdates, tungstates, silicates, phosphates, borates and the rare earth cations of Ce, Y, La, Eu, Gd, and Nd. The combinations of the present invention have been discovered to behave synergistically for corrosion inhibition of metals, including aluminum alloys. Other embodiments of the present invention include corrosion inhibitors for aerospace alloys such as aluminum alloy 2024-T3, corrosion inhibitive pigments for aerospace paints, conversion coatings, and corrosion protection of other metals in cooling water applications, surface finishing baths, cutting fluids for tools and machinery, and other areas where corrosion inhibition and protection is required. The corrosion inhibitors of the present invention are chrome-free, which is very desirable for health and environmental reasons.

BACKGROUND OF THE INVENTION

Aluminum and its alloys have found increasing use in recent years in many industrial and consumer applications due to their light weight and high strength properties. Aircraft airframes and outer skins are among the more demanding applications for aluminum and its alloys. In order to preserve the large capital investment in aircraft, it is necessary to protect the aircraft from corrosion that is frequently initiated by environmental factors, such as water, oxygen, and chloride or other ions, that react with aluminum to produce a corrosion product with resultant weakening of the aluminum or aluminum alloy structure. To prevent or minimize corrosion, the metal structure is usually provided with a protective coating that is usually applied in one or more layers. In the case of multi-layer coatings, the first layer is a chromate conversion coating made with a Hexavalent chromium-containing bath chemistry. The second or primer layer that is tenaciously adherent to the conversion coating, typically includes an organic polymer within which is dispersed chromate corrosion-inhibiting compounds. Other layer(s) are then applied over the primer layer. These layer(s) may also be polymer-based and may include colored pigments to produce decorative effects, such as the airline colors. In certain instances, a unilayer coating ("unicoat") is applied which contains the corrosion inhibiting compound and any optional coloring pigments.

Recently hexavalent chromate ions have been the subject of health concerns. As a result of these concerns, the United States Environmental Protection Agency (EPA) has promulgated regulations to phase out the use of chromate-type corrosion inhibitors. As a result, alternatives must be found.

There exists a need for a coating that contains a chromate-free corrosion inhibiting compound or mixture that may be coated over substrates of aluminum and its alloys to protect the substrate from corrosion. More specifically, for the aircraft industry, the corrosion inhibitors and coating materials must meet high performance criteria. The corrosion inhibitor and conversion coating materials must be able to prevent detectable pitting corrosion after an aluminum or aluminum alloy substrate, coated with a composition that includes the corrosion inhibitor, has been exposed to a salt spray for 3,000 hours. Moreover, the corrosion inhibitor and conversion coating material should not pose the health and environmental hazards that currently raise concerns about chromate inhibitors.

SUMMARY OF THE INVENTION

The invention provides chromate-free, corrosion-inhibition of aluminum, aluminum alloys, and other metals and alloys when in solution, within coating mixtures, and coatings formed from the coating mixtures or, when released from other containment vehicles of any size. Embodiments of the corrosion-inhibiting compounds of the present invention do not pose the health hazards associated with hexavalent chromium compounds. In addition, coatings that contain the invention have "active corrosion protection" in that the inhibitors of the coating have sufficient inhibitor efficiency and diffusive capability so as to migrate into damaged areas of the coating to protect the bared substrate area from corrosion.

As stated above, embodiments of the present invention include combinations of two or more materials that comprise the compositions of the present invention, such as at least binary combinations of vanadates, molybdates, tungstates, silicates, phosphates, borates and the rare earth cations of Ce, Y, La, Eu, Gd, and Nd.

More specifically, embodiments of the present invention include anti-corrosive compositions, comprising: a combination of at least two of the following materials: vanadates, molybdates, tungstates, silicates, phosphates, borates, Ce cations, Y cations, La cations, Eu cations, Gd, cations, Nd cations; provided that combinations that consist of two or more of the following materials are excluded: vanadates, borates, Ce cations, Y cations, La cations. That is, combinations that consist of vanadates, borates, Ce cations, Y cations, La cations are excluded as embodiments of the compositions of the present invention.

The combinations specifically include binary combinations and combinations of three or more materials.

The following combinations are non-limiting examples of binary combinations of chemical species of the present invention that show synergy at some or all of the ratios of the constituents examined:

Sodium Metavanadate and Sodium Metatungstate
Sodium Metavanadate and Sodium Metasilicate
Sodium Metavanadate and Sodium Phosphate
Sodium Metavanadate and Sodium Molybdate
Barium Metaborate and Sodium Metatungstate
Barium Metaborate and Sodium Metasilicate
Cerium Chloride and Sodium Metatungstate
Cerium Chloride and Sodium Metasilicate
Cerium Chloride and Sodium Molybdate
Yttrium Chloride and Sodium Metatungstate Yttrium Chloride and Potassium Phosphate
Yttrium Chloride and Sodium Phosphate
Yttrium Chloride and Sodium Metasilicate
Yttrium Chloride and Sodium Molybdate
Europium Chloride and Sodium Molybdate
Gadolinium Chloride and Sodium Molybdate
Neodymium Chloride and Sodium Molybdate
Sodium Metatungstate and Potassium Phosphate
Sodium Metatungstate and Lanthanum Chloride
Sodium Metatungstate and Sodium Metasilicate
Sodium Metatungstate and Sodium Molybdate
Potassium Phosphate and Lanthanum Chloride
Potassium Phosphate and Sodium Molybdate
Lanthanum Chloride and Sodium Metasilicate
Lanthanum Chloride and Sodium Phosphate
Lanthanum Chloride and Sodium Molybdate
Sodium Metasilicate and Sodium Phosphate
Sodium Metasilicate and Sodium Molybdate
Sodium Phosphate and Sodium Molybdate.

The following combinations are non-limiting examples of ternary combinations of chemical species of the present invention that show synergy at some or all of the ratios of the constituents examined:

Sodium Metavanadate and Sodium Metasilicate and Sodium Molybdate
Sodium Metavanadate and Sodium Metasilicate and Sodium Phosphate
Sodium Metavanadate and Sodium Phosphate and Sodium Molybdate
Cerium Chloride and Lanthanum Chloride and Sodium Metasilicate.
sodium metavanadate, sodium metasilicate, lanthanum chloride.
sodium metavanadate, sodium molybdate, lanthanum chloride.
cerium chloride, lanthanum chloride, sodium metavanadate.
cerium chloride, lanthanum chloride, sodium molybdate.
cerium chloride, sodium metasilicate, sodium molybdate.

Embodiments of the present invention are non-chromate corrosion inhibitors to protect aluminum, aluminum alloys, and other metals and alloys and can be used as inhibitive pigments for aerospace coatings, compounds in conversion coating fabrication, corrosion protection of metals and alloys in cooling water applications, surface finishing baths, cutting fluids for tools and machinery, and other areas where corrosion inhibition is required. The materials of these embodiments may be used, among other things, to inhibit corrosion for military and civilian applications for aircraft, land vehicles, ships, bridges, and any other engineered structure used in corrosive environments.

The present invention is also directed to compounds that contain the anions and cations covered herein. Additionally, embodiments of the present invention can be packaged and/or delivered in a number of ways. For example, many of the compounds and/or compositions of the present invention are very soluble in water. Consequently, such compounds and/or compositions must be wrapped, contained, or packaged in a way to control their solubility so that they can be used in paints and prevent osmotic blisters. These chemical species can also exist in less soluble compounds.

Another embodiment of the present invention is a high throughput screening method for corrosion inhibitor discovery related to cyclic voltammetry detection, including cyclic voltammetry detection of surface enhanced copper on AA2024-T3 and other Al—Cu alloys.

Another embodiment of the present invention is related to fluorometric assessment of corrosion products, including fluorometric assessment of corrosion products of AA2024-T3 and other metals for high throughput screening of corrosion inhibitors.

Another embodiment of the present invention is a high throughput screening method for corrosion inhibitor discovery related to DC methods, including DC polarization for the determination of polarization resistance on AA2024-T3 and other metals.

Another embodiment is method of making anti-corrosive compositions. Another embodiment is method of making conversion coatings on a substrate.

BRIEF DESCRIPTION OF THE DRAWINGS

FIG. 11 shows current from MMA testing of 3.4 mM $NaVO_3$/$Na_2SiO_3$ varying pH 2-12.

FIG. 12 is a table that summarizes synergy behavior based on measured surface enhanced copper on the surface of an aerospace alloy (AA2024-T3).

FIG. 13 is a table that summarizes synergy behavior based on measured surface enhanced copper on the surface of an aerospace alloy (AA2024-T3) and on the corrosion current.

DESCRIPTION OF THE INVENTION

Figure 1:
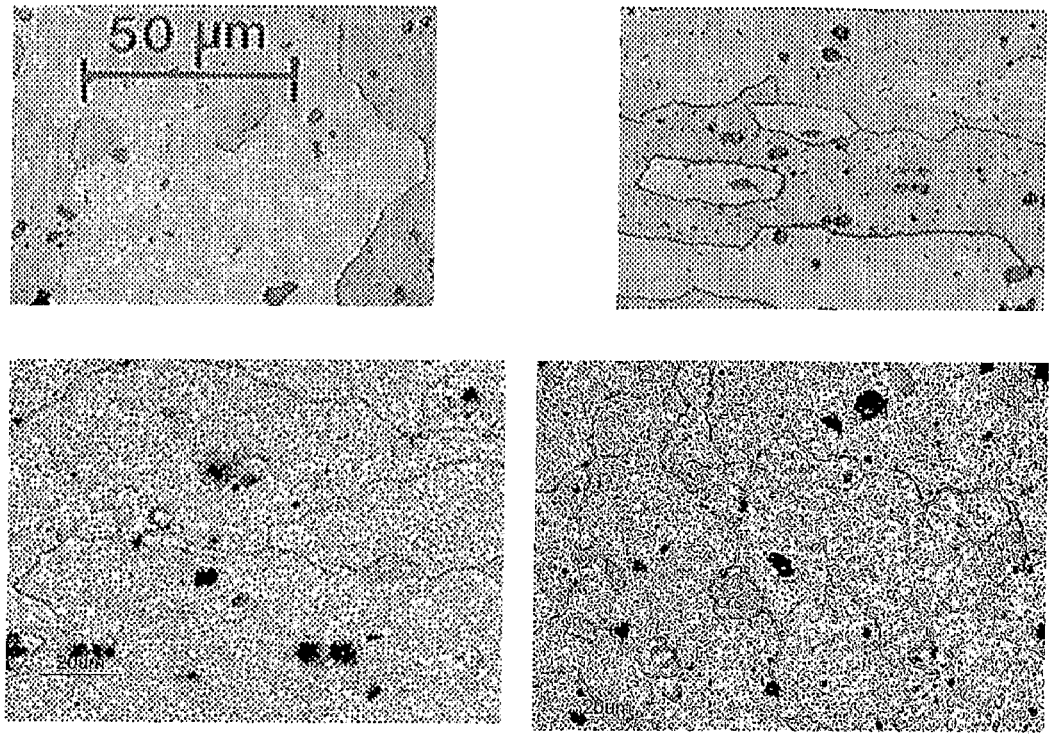
FIG. 1 is the metallography of 2024 sheet (top left and right), cross-section of 2024 wire (bottom right), longitudinal cross-section of 2024 wire (bottom left).

The corrosion inhibition by numerous compounds has been examined through the years with the hope of providing a chromate replacement. These compounds include molybdates, vanadium-based compounds, boron-based compounds, and rare earth salts. Recently, many of these compounds have been examined for inhibitor efficacy on aerospace aluminum alloys. However, no single compound has yet demonstrated an effective corrosion inhibition power (efficiency at specified concentration) on these aerospace alloys that compares to chromate-based inhibitors.

The present inventors have discovered an alternative to the use of a single inhibitor species is that of using synergistic combinations of two or more compounds. Synergy occurs when inhibition by the combination exceeds the arithmetic sum of the inhibition by individual components. Synergistic combinations of inhibitors have been examined extensively for steel in acidified and neutral aqueous environments, as well as for copper in neutral aqueous environments.

Examples of the present invention include 1:1 ratios of these materials, ratios other than 1:1, and many different concentrations. Additionally, the substrate may be exposed to these compounds either simultaneously or in a sequence. The predictive abilities and fundamental understanding of molecular systems with more than two different atomic species remains extremely limited, so that one is faced with an expansive matrix of experiments to identify the optimum inhibitor combination under a wide range of test conditions (e.g. pH, T, choice of A and B, ratio of A and B, concentration of A+B, etc.).

Therefore, other aspects of the present invention include approaches to increase the rate of material discovery through combinatorial approaches. Combinatorics, initially utilized in electronics development, has been more commonly associated with automated synthesis and high throughput screening for pharmaceuticals. In the combinatorial process, large arrays of material or chemical variables can be produced and screened to identify the optimum process or condition of interest. Creation of the combinatorial library is typically straightforward. However, the identification of a rapid evaluation method that can sensitively detect changes in the relevant parameter is not to be assumed and is often the rate limiting process in rapid discovery. This idea of rapid detection of corrosion inhibitors is further complicated by the time variation in inhibitor performance.

The corrosion protection properties of inhibitors can be electrochemically quantified in many different ways, however there are presently no specified electrochemical methods that can be implemented in a rapid fashion (i.e. within minutes) in the laboratory to predict long-term (i.e. years) corrosion protection. Yet, the long-term desire is to screen thousands of chemical compounds with an infinite number of chemical combinations in a vast number of environmental conditions (temperature, pH, concentration, etc.). The idea of "screening" for rapid discovery must be emphasized. Once large numbers of materials and test conditions have been examined and promising target compounds have been identified, a more rigorous scheme of testing can then be implemented to more carefully document the inhibition properties of these targets.

Examples of the present invention may be made by several methods. One such method comprises the steps of providing a mixture that contains one or more of the target species described herein, or any compound or mixture derived from any other compound or mixture that contains the designated target species. For example, a component can contain one or more of the target species and will be designated by number; 1, 2, 3, etc.

Procedure 1: Mix component 1 with one or more additional components in a common medium (e.g., water, organic resin, oil, etc.) and expose the mixed components to the metal either by immersion, spray, etc. Any combination of components, any concentration, and any time can be used.

Procedure 2: Mix component 1 in a medium (e.g., water, organic resin, oil, etc.). Mix component 2 in a separate medium, and any other component in a separate medium. Expose the metal to each mixture in series, in any order, at any concentration, and for any time duration.

The compositions of the present invention may be used as coatings or within coatings as known in the art. For example, the coatings may be applied to a surface as described in U.S. Pat. Nos. 6,077,885; 5,866,652; and other documents cited herein.

Examples of the Present Invention

The following, and all examples herein, are specifically not intended to be limiting of the present invention.

The method of this example demonstrates a method to determine potential inhibitor combinations and compare their performance in short-term testing to the performance of chromate for the mitigation of corrosion on AA2024-T3 substrates. Additionally, this example demonstrates corrosion inhibition by the synergistic combinations of the present invention.

Materials

Aluminum alloy 2024 wire (California Fine Wire) with a diameter of 1.59 mm (1/16") was obtained for use as electrodes in electrochemical testing. Metallography was carried out on the AA2024 wire to examine the differences in grain structure and intermetallic particle distribution between the AA2024 wire and AA2024 sheet. Optical microscopy (FIG. 1) revealed that the 2024 wire microstructure was qualitatively similar to that found in 2024 sheet used on aircraft.

Electrochemical Testing

High-throughput testing of multiple electrochemical cells was accomplished by the use of the multichannel microelectrode analyzer (NMA) (Scribner, Associates, Southern Pines, N.C.) in combination with an array of electrochemical cells established through the use of a conventional 8×12 reaction frame and fabricated top to contain the wire electrodes. The MMA is a group of 10 modules of 10 zero resistance ammeters (100 total ZRA's) that can be used for current or potential measurement of electrodes. The modules may be changed out to allow measurement of different current ranges. The range used for these experiments allowed clear measurement between 1 nanoamp and 10 microamps. The MMA is computer controlled and is attached to the electrodes in the reaction frame by means of an adapter.

Figure 2:
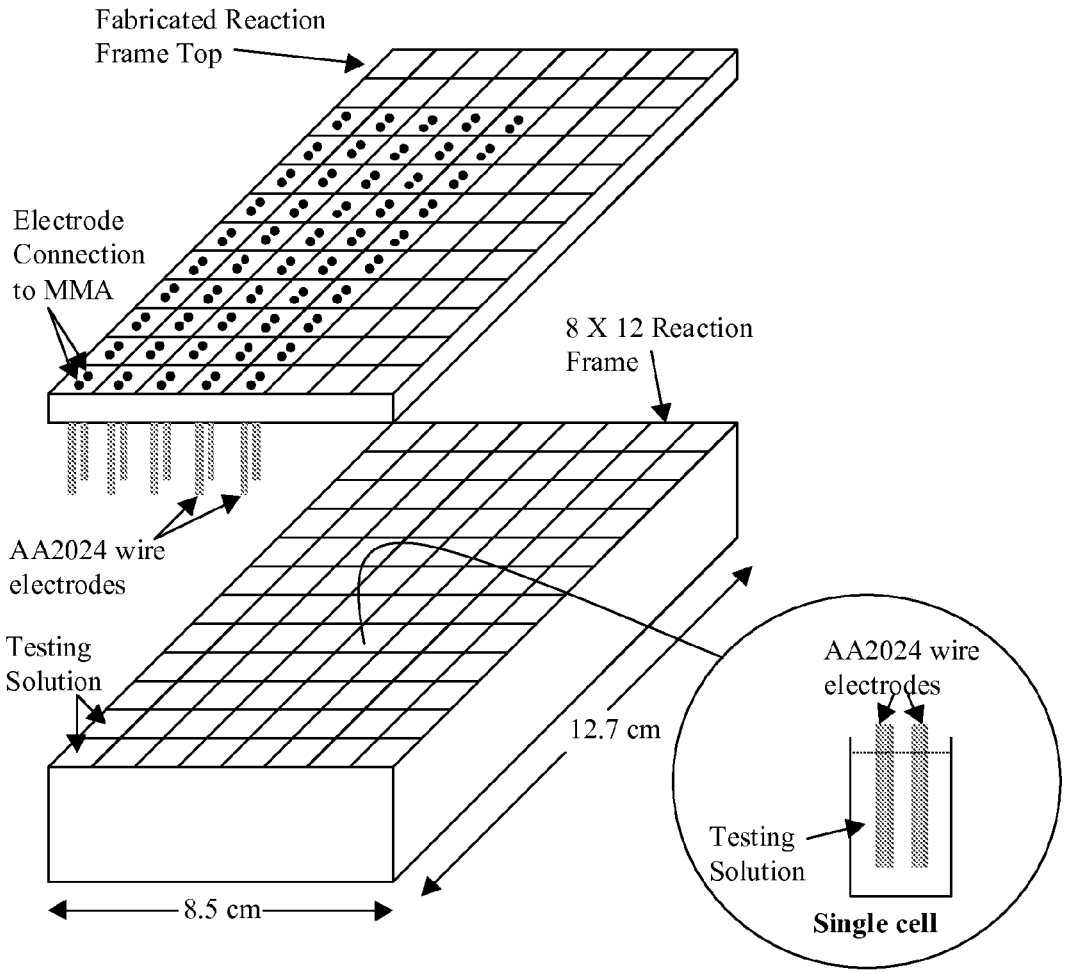
FIG. 2 is a schematic of a two-electrode array of AA2024 wires and reaction frame.

50 cells of the conventional 8×12 reaction frame were used to house 50 independent chemistries. Two AA2024 wire electrodes were plugged into electrical contacts contained in the fabricated top for each of the 50 cells, totaling 100 wire electrodes connected to the MNA. The fabricated top is then placed on the reaction frame (not air-tight) containing the chemistries of interest. Each module on the MMA can then be set to establish a potential of one wire electrode vs. the other. A schematic of the reaction frame setup is shown in FIG. 2.

Previously, testing of a series of inhibitors was conducted by electrochemical impedance spectroscopy to obtain information on inhibitor performance on AA2024-T3 sheet exposed to chloride. The testing was conducted by placing an AA2024-T3 coupon in 3.4 mM inhibitor and 0.6 M NaCl solution. These are very harsh conditions, but represent the type of environment in which chromates can and do perform. EIS was conducted on the samples at initial exposure and exposures of 1, 3, 5 and 10 days. The results of the EIS testing for neutral pH solutions are presented in FIG. 3. It can be seen in this Figure that the trendlines fluctuate significantly at early times and are not at steady state even at 10 days. Nonetheless, there were certain inhibitors that demonstrated consistent ordinal ranking of corrosion resistance (polarization resistance, $R_P$, minus the diffusional impedance, $R_D$) over all 10 days of testing and were selected as target data for this study. Three compounds were selected for testing along with the control (no inhibitor): cerium chloride, yttrium chloride, and sodium metatungstate. These data are emboldened in FIG. 3.

Since earlier EIS testing indicated that the corrosion resistance was a suitable indicator of inhibitor performance, initial experiments with the MMA have focused on the DC acquisition of the polarization resistance. While the MMA is fully capable of performing 3-electrode potentiostatic and potentiodynamic experiments, the initial experiments performed here have focused on more simple methods that are rapid and amenable to the idea of high-throughput experimentation. A crude form of the polarization resistance was obtained through a low amplitude DC bias applied between two electrodes. Two-electrode DC bias measurements were performed using two 4.45 cm (1.75") long AA2024 wire electrodes attached to the reaction frame. This allowed 3.3 cm (1.3") of length and 1.65 $cm^2$ ($0.255"^2$) of surface area to be exposed to solution. One electrode in each cell was polarized 100 mV (to −425 $mV_{SHE}$) with respect to the other electrode, which was maintained at a potential of −525 $mV_{SHE}$, corresponding to the open circuit potential of the control. The resulting current between the two electrodes was measured over a time period of 9 hours. The NMA device measured the current between the paired electrodes using an in-line ZRA. 100 mV bias was used to ensure that the nanoampere limitation on measurement would not interfere with evaluation of effective inhibitors and combinations.

Other potential screening methods could include a lower DC polarization, possibly 10-50 mV, cyclic voltammetry, or fluorometric methods of assaying corrosion product concentrations.

Cells of the reaction frame were filled with a solution containing 3.4 mM inhibitor and 0.6 M NaCl adjusted to pH 7 to match the chemistries used in the previous EIS study. The change of solution pH due to solution chemistry changes caused by electrode corrosion was not monitored. 1.75 mL of solution was pipetted into each test cell of the reaction frame. The experimental method listed above was modified slightly for screening of potential inhibitor synergies after the initial experiments discussed above proved promising. Two-electrode DC bias measurements were performed as above but using 2.54 cm (1") 2024 wires as electrodes on the reaction frame. 1.7 cm (0.67") of the length and 0.85 $cm^2$ (0.13") of surface area of the AA2024 wire were exposed to the solution in the testing cell. One electrode in each cell was again polarized 100 mV (to −425 $mV_{SHE}$) with respect to the other electrode, which was maintained at a potential of −525 $mV_{SHE}$, corresponding to the open circuit potential of the control. 50 cells of the reaction frame were used in each testing interval to maximize throughput in the screening for potential inhibitor synergies. Again, the current established between two-wire electrodes biased 100 mV apart was measured over a time period of 9 hours.

Cells of the reaction frame in the synergy screening experiments were filled with 2 mL of 3.4 mM total inhibitor in 0.6 M NaCl solution. Forty-four inhibitor combinations were tested in this stage of the screening process and were adjusted to pH 7 by addition of HCl or NaOH. Screening was performed on solutions containing 0.2 mM (5.9%), 0.7 mM (20.6%), 1.2 mM (35.3%), 1.7 mM (50%), 2.2 mM (64.7%), 2.7 mM (79.4%), and 3.2 mM (94.1%) of inhibitor A with the balance of the 3.4 mM total inhibitor comprised of inhibitor B for all 44 inhibitor combinations.

One advantage of high throughput screening process of the present invention is the potential to explore numerous variables, e.g. pH, temperature, concentration, and others. In this example, the variables examined were actual inhibitor in the mixture, ratio of inhibitors, and pH.

Individual Inhibitor Testing

Figure 4:
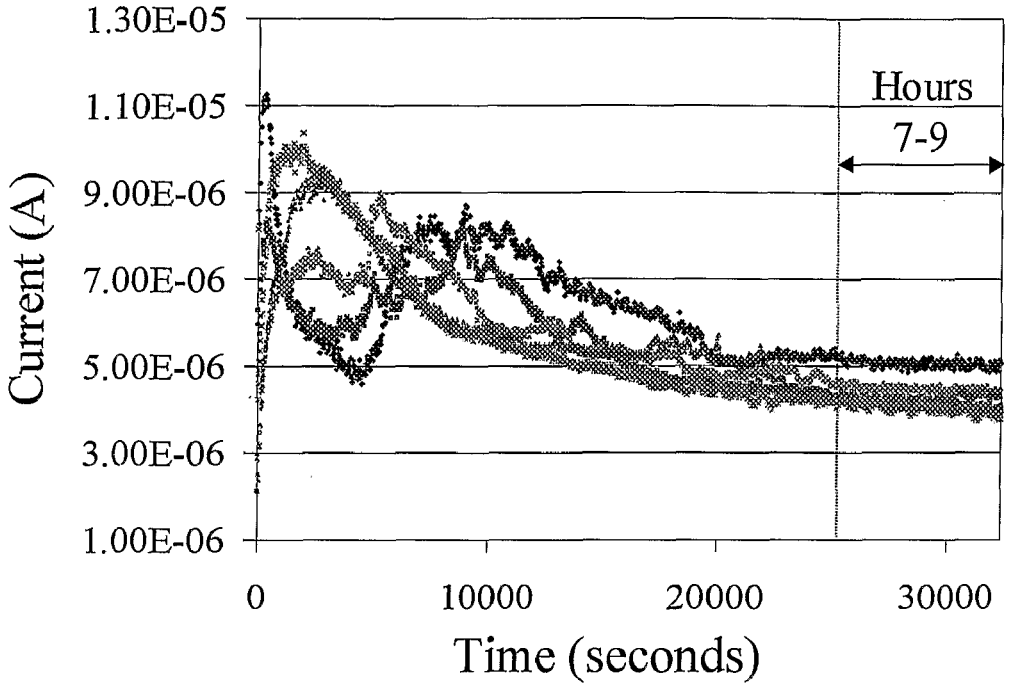
FIG. 4 is a graph showing an example of MMA (multiple micro-electrode analyzer) output—$I_{2024/2024}$—100 mV bias of AA2024 electrodes exposed to 3.4 mM $Na_3PO_4$ in 0.6 M NaCl solution adjusted to pH 7.

Results from the DC polarization tests for the individual inhibitors were plotted to examine the current change over the course of the 9 hour test. An example of data from the 100 mV polarization high throughput screening experiments is shown in FIG. 4.

As can be seen, the data from these polarization experiments changes significantly at early times (1-6 hours) and tends to become more stable in overall behavior near the $7^{th}$ hour. While additional time may (or may not) lead to steady-state behavior, a decision was made to collect current data from each cell for 2 hours, from the $7^{th}$ hour to the $9^{th}$ hour to provide the characteristic data for any particular inhibitor. This decision was a compromise between possible increased accuracy by extending the time of measurement to more closely approach steady state and speed of data acquisition to facilitate the theme of high throughput screening. In addition to general current trendline, a more detailed observation of the current for each inhibitor showed that noise was present in all of the cells tested. This was believed to be electrochemical noise as the amount varied depending on the inhibitor chemistry of the cell. Noise analysis represents yet another approach that might be examined for high throughput screening.

The ordinal ranking of inhibitor performance using the 100 mV polarization screening results correlated 100% with the ordinal ranking of the EIS and statistical pit analysis for the four chemistries selected, i.e. cerium chloride>yttrium chloride>control>sodium metatungstate.

Figure 5:
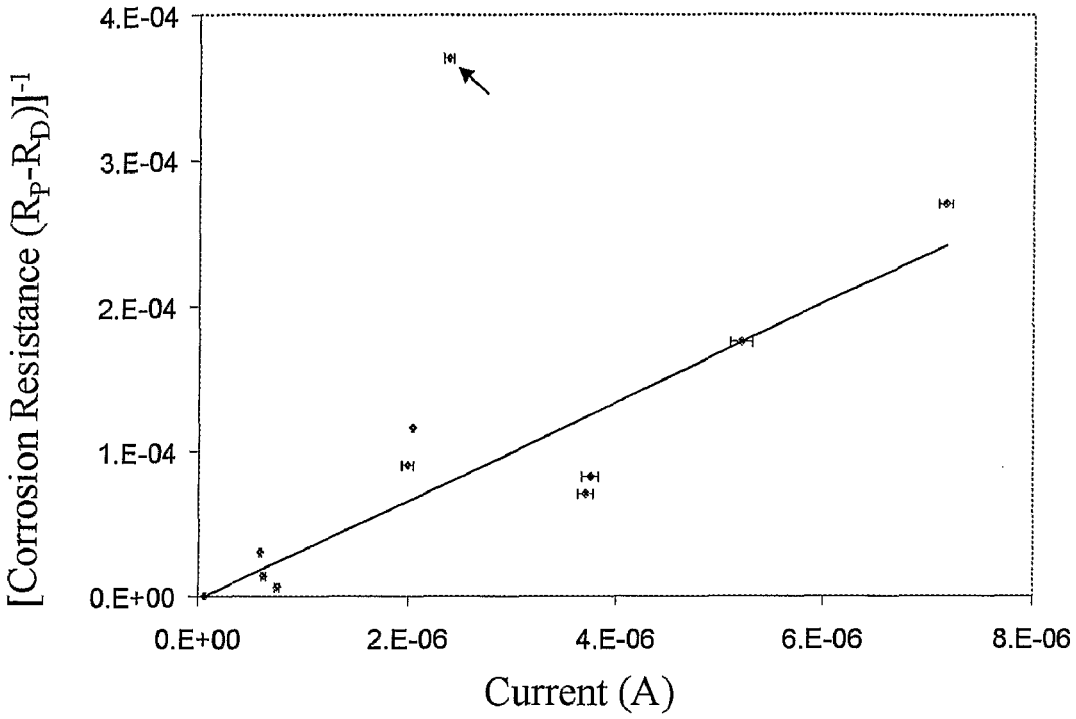
FIG. 5 is a graph showing a comparison of inhibitor performance in EIS and 100 mV DC bias rapid screening for 11 different chemistries.

Comparison of 100 mV DC bias screening results and 10 day electrochemical impedance testing of 11 single corrosion inhibitors is shown in FIG. 5. A linear regression between $1/R_C$ and $i_{corr}$ was used to compare data collected by the two different test methods, EIS (previous tests) and the HTS. This comparison was selected due to the widely known correlation $R_p=B/I_{corr}$. A $R^2$ value of 0.86 was determined when the data point marked by the arrow was excluded from the regression.

Examples of Inhibitor Combinations of the Present Invention

With respect to the present invention, synergy is said to occur, for iso-concentration comparisons, when any combination of more than one inhibitor produces a lower current than any of the chemical constituents alone. This definition of synergy differs slightly from synergy calculations of others where inhibition efficiencies are compared between exact chemical composition of each constituent and combination as shown in the formula below for chemical composition: x mM chemical A+y mM chemical B:

$$\text{Synergy Parameter } (S_{AB}) = 1 - [(IE_{(x\ mM\ A)} + IE_{(y\ mM\ B)}) - (IE_{(x\ mM\ A)} \times IE_{(y\ mM\ B)})][1 - IE_{(x\ mM\ A + y\ mM\ B)}]$$

where:

$$\text{Inhibition efficiency } (I.E.) = [1 - (I_{inhibited}/I_{uninhibited})] \times 100\%$$

With respect to the present invention, the currents measured for any and all inhibitor experiments was always compared to the same set (n=200+) of pooled control (no inhibitor) results. Efficiency is used here because good inhibitors are represented with high values.

Using the definition of synergy above, where the synergy is said to occur at any current lower than the best inhibitor alone, boundary lines of synergy and antagonism were created in each system. The synergy line is merely the best performing single inhibitor and the antagonism line is the worst performing single inhibitor for that system. Confidence in these boundary lines is high, as the single inhibitor currents are averaged from at least 25 separate test cells for each inhibitor. The largest standard deviation for the single inhibitor values of current was 3% of the mean current. Standard deviations are shown for the remaining data points.

Figure 6:
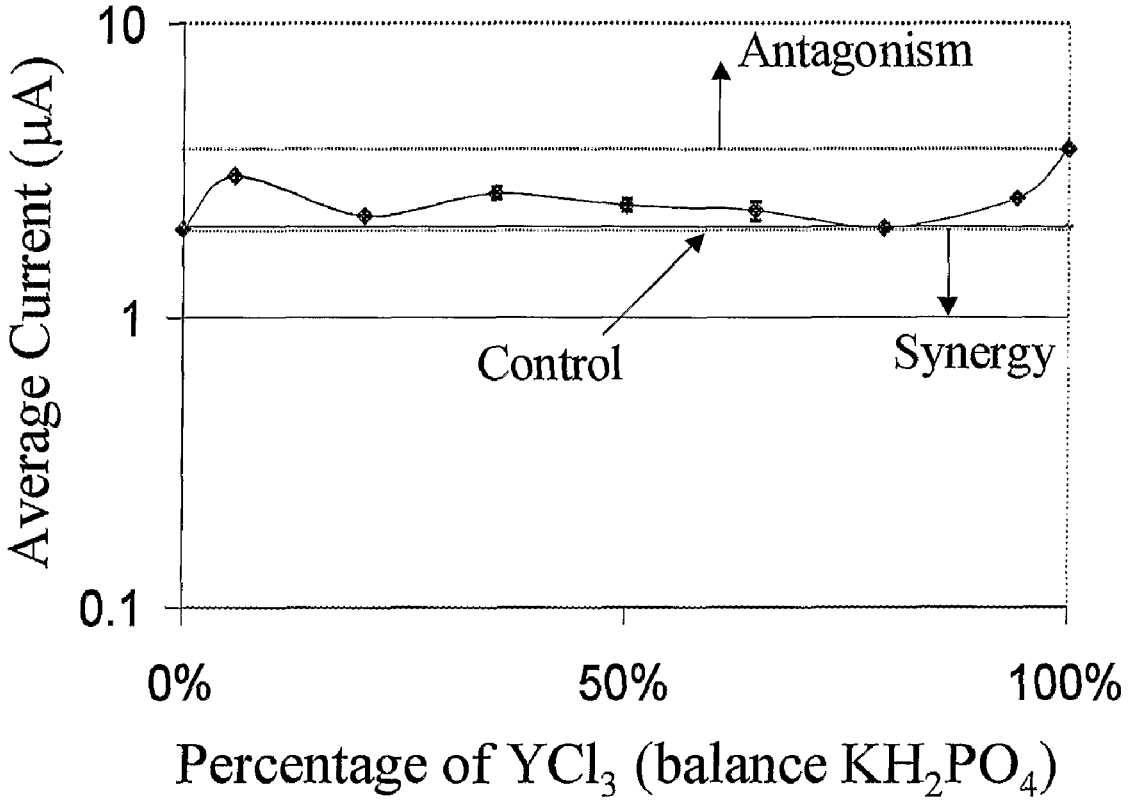
FIG. 6 is a plot showing a current of 3.4 mM $KH_2PO_4$/$YCl_3$, 0.6 M NaCl (pH 7)

Screening of potential inhibitor synergies using the method of the present invention reveals several types of inhibitor combination behavior. Some of the inhibitor combinations examined exhibit no apparent benefit of mixing the inhibitors. The current from testing of these mixtures is not lower than the better inhibitor alone at the same total inhibitor concentration or higher than the worse inhibitor alone. An example of this lack of benefit behavior may be seen in the results of testing a mixture of potassium phosphate and yttrium chloride shown in FIG. 6. FIG. 6 shows that the resulting current when using any ratio of potassium phosphate and yttrium chloride falls between the current for each inhibitor alone at 3.4 mM total inhibitor concentration. This type of behavior was observed in approximately 20% of the combinations tested here.

Figure 7:
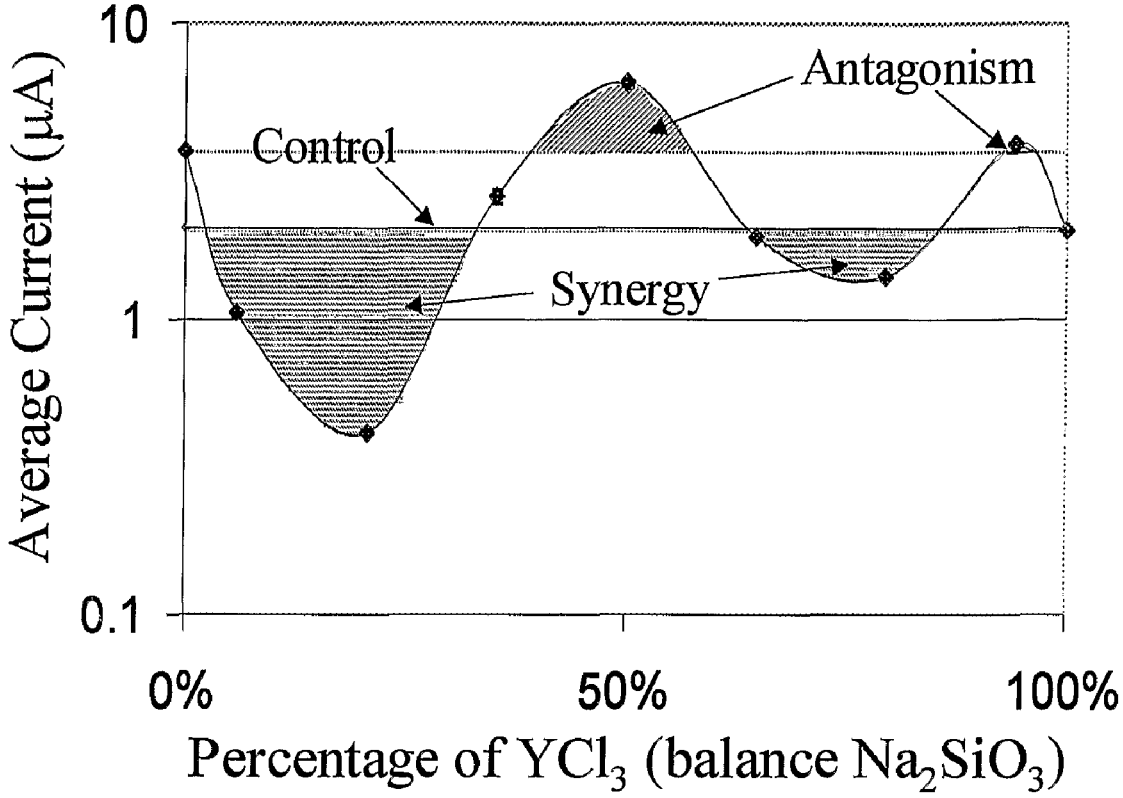
FIG. 7 is a plot showing a current of 3.4 mM $Na_2SiO_3$/$YCl_3$, 0.6 M NaCl (pH 7).

Another type of behavior observed in about 35% of the inhibitor mixtures tested is the presence of both synergy and antagonism (i.e., the opposite of synergy) across the ratio of concentration of the two inhibitors. An example of such a mixture is that of sodium metasilicate and yttrium chloride shown in FIG. 7. In FIG. 7, the mixtures of 0.2 mM $YCl_3$/3.2 mM $Na_2SiO_3$, 0.7 mM $YCl_3$/2.7 mM $Na_2SiO_3$, 2.2 mM $YCl_3$/1.2 mM $Na_2SiO_3$, and 2.7 mM $YCl_3$/07 mM $Na_2SiO_3$ exhibited synergy, since the current at each mixture was lower than $YCl_3$ alone. Interestingly, the combinations of 1.7 mM $YCl_3$/1.7 mM $Na_2SiO_3$ and 3.2 MM $YCl_3$/0.2 mM $Na_2SiO_3$ exhibited antagonism, where the currents at each of these combinations was higher than that of $Na_2SiO_3$ alone.

Figure 8:
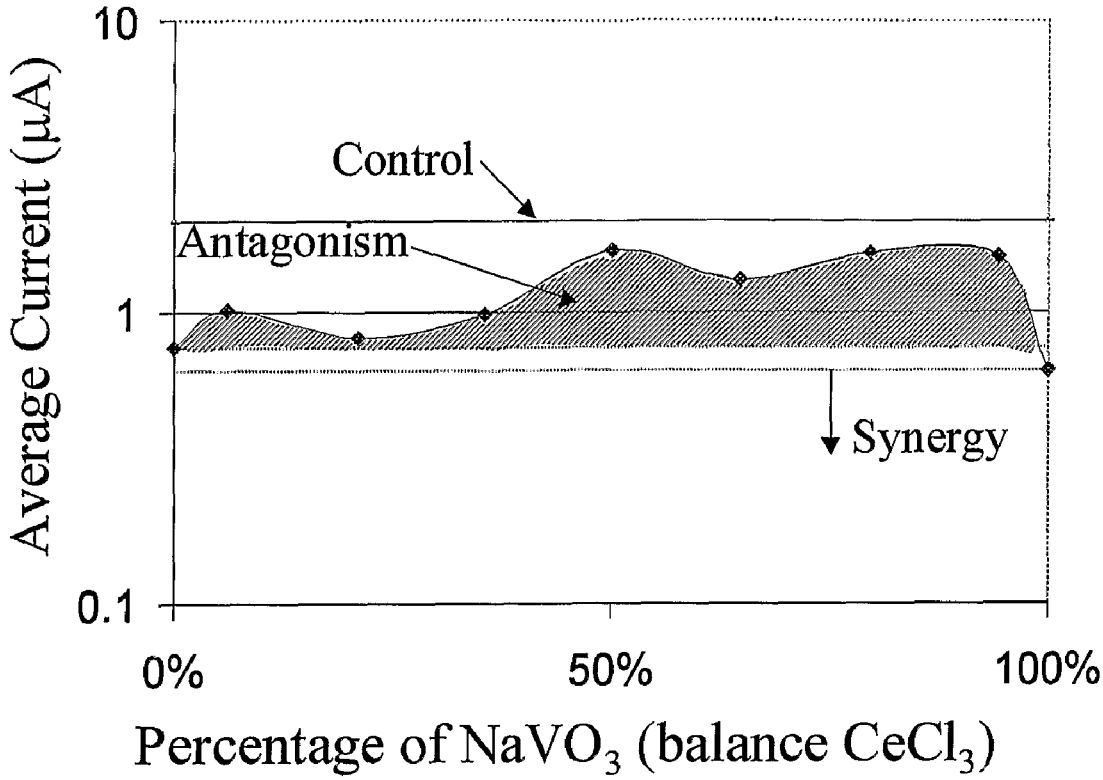
FIG. 8 is a plot showing a current of 3.4 mM $NaVO_3$/$CeCl_3$, 0.6 M NaCl (pH 7).

Yet another type of behavior observed from the testing of mixtures is antagonism at some or all ratios of the inhibitors. The behavior of limited-range antagonism, arbitrarily defined as the occurrence of antagonism in less than half of the ratios for any given inhibitor mixture. This behavior was observed in less than 10% of the inhibitor mixtures examined. Approximately 10% of the inhibitor mixtures examined showed antagonism at all ratios. The mixture of sodium metavanadate and cerium chloride is an example of a mixture that exhibited antagonism at all ratios of the inhibitors and is shown in FIG. 8. In FIG. 8 it can be readily observed that the current from any ratio of the two inhibitors results in an increased current over either of the inhibitors alone. The behavior of this mixture is interesting because each inhibitor alone is ranked among the best of the non-chromate inhibitors for AA2024 but combined they are more detrimental to the alloy.

Figure 9:
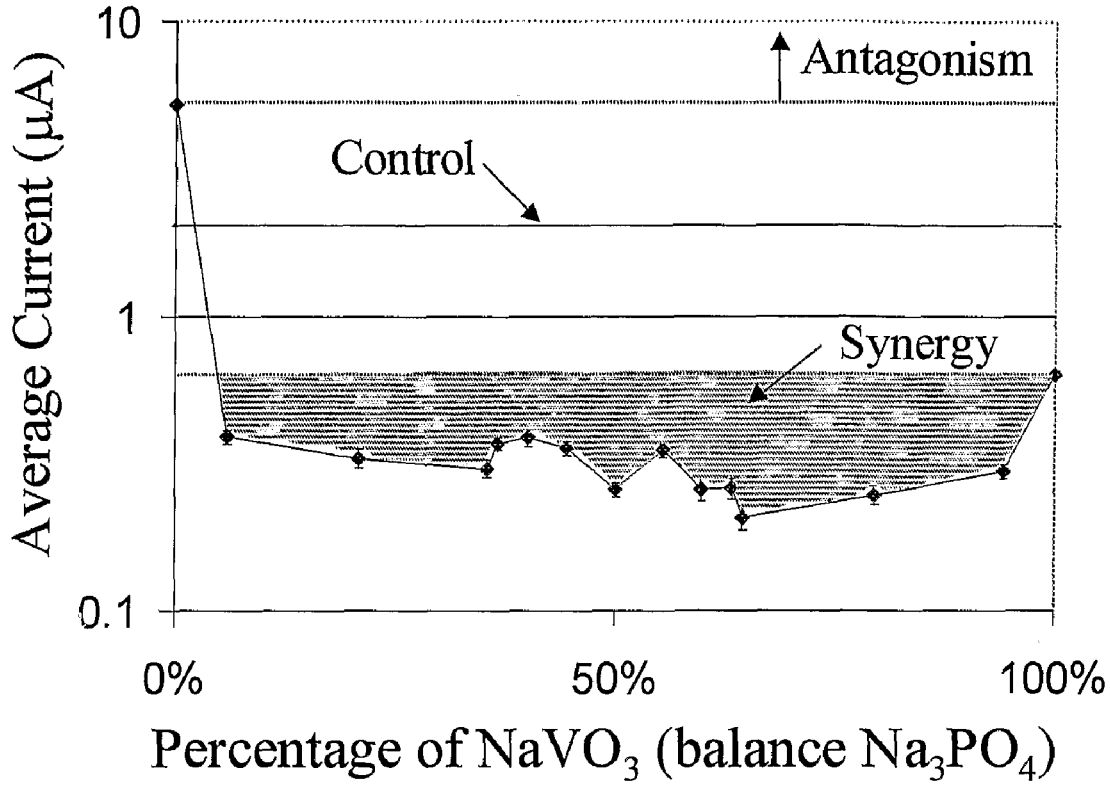
FIG. 9 is a plat showing a current of 3.4 mM $NaVO_3$/$Na_3PO_4$, 0.6 M NaCl (pH 7).

Finally, the most sought after behavior that was observed in testing of the inhibitor mixtures is the presence of synergy across some or all ratios of the inhibitors. The behavior of limited-range synergy, arbitrarily defined as having less than half of the ratios of the inhibitor mixture exhibit synergy, was observed in approximately 20% of the forty-four inhibitor mixtures examined at pH 7. Broad-range synergy, in which synergy was demonstrated at all concentrations tested was observed in less than 10% of the 44 mixtures tested. The mixture of sodium phosphate and sodium metavanadate is an example of a mixture that exhibited synergy at all tested ratios of the inhibitors and may be seen in FIG. 9. Mixtures exhibiting synergy at all ratios of the combined inhibitors are considered the safest to implement in a coating system. If a non-ideal ratio of the inhibitors is released from the coating, no detrimental effects from that mixture of inhibitors should exist.

A summary of the observed behavior of the forty-four inhibitor mixtures tested at pH 7 is presented in Table 1 below. The percentage of points exhibiting either synergy or antagonism is based on a comparison of the current of the mixture to the constituents of the mixture alone. For example, testing of 3.4 mM mixtures: 0.2 mM of compound A balance of compound B, 0.7 mM of A balance of B, 1.2 mM of A balance of B, 1.7 mM of A balance of B 2.2 mM of A balance of B, 2.7 mM of A balance of B, 3.2 mM of A balance of B, represents 7 different mixtures to be considered. If two of these points fall below the current of the best single inhibitor present in that system, then 2 of the 7 points are said to exhibit synergy, leading to a value of 28.6% of the points exhibiting synergy. A mixture current less than the control refers to a mixture where all of the ratios of that mixture exhibit inhibition, regardless of any synergy present. Finally, the percentage of ratios of the mixture tested with currents under 0.6 microamps refers to mixtures that present more inhibition than the best non-chromate inhibitor tested here.

TABLE 1

Inhibitor mixture behavior observed from 100 mV polarization high throughput screening testing

| Inhibitor A | Inhibitor B | Behavior Observed | Percentage Points Exhibiting Synergy | Percentage Points Exhibiting Antagonism | All Mixture Currents Less than Control? | Percentage Points with Currents Under 0.6 microamps |
|---|---|---|---|---|---|---|
| NaVO3 | BaB2O4 | Mild Synergy | 14.3% | 0.0% | yes | 14.3% |
| NaVO3 | CeCl3 | Antagonism | 0.0% | 100.0% | yes | 0.0% |
| NaVO3 | YCl3 | Synergy | 100.0% | 0.0% | yes | 100.0% |
| NaVO3 | NaWO4-3WO3 | Lack of Benefit | 0.0% | 0.0% | yes | 0.0% |
| NaVO3 | KH2PO4 | Lack of Benefit | 0.0% | 0.0% | yes | 0.0% |
| NaVO3 | LaCl3 | Antagonism | 0.0% | 100.0% | yes | 0.0% |
| NaVO3 | Na2SiO3 | Synergy | 100.0% | 0.0% | yes | 100.0% |

TABLE 1-continued

Inhibitor mixture behavior observed from 100 mV polarization high throughput screening testing

| Inhibitor A | Inhibitor B | Behavior Observed | Percentage Points Exhibiting Synergy | Percentage Points Exhibiting Antagonism | All Mixture Currents Less than Control? | Percentage Points with Currents Under 0.6 microamps |
|---|---|---|---|---|---|---|
| NaVO3 | Na3PO4 | Synergy | 100.0% | 0.0% | yes | 100.0% |
| NaVO3 | Na2MoO4 | Synergy | 100.0% | 0.0% | yes | 100.0% |
| BaB2O4 | CeCl3 | Mild Synergy | 42.9% | 0.0% | no | 42.9% |
| BaB2O4 | YCl3 | Synergy | 71.4% | 0.0% | no | 0.0% |
| BaB2O4 | NaWO4-3WO3 | Synergy and Antagonism | 28.6% | 28.6% | no | 0.0% |
| BaB2O4 | KH2PO4 | Antagonism | 0.0% | 71.4% | no | 0.0% |
| BaB2O4 | LaCl3 | Mild Synergy | 14.3% | 0.0% | no | 14.3% |
| BaB2O4 | Na2SiO3 | Lack of Benefit | 0.0% | 0.0% | no | 0.0% |
| BaB2O4 | Na3PO4 | Synergy and Antagonism | 14.3% | 71.4% | no | 0.0% |
| BaB2O4 | Na2MoO4 | Mild Antagonism | 0.0% | 42.9% | no | 0.0% |
| CeCl3 | YCl3 | Synergy and Antagonism | 28.6% | 28.6% | no | 0.0% |
| CeCl3 | NaWO4-3WO3 | Mild Synergy | 28.6% | 0.0% | no | 0.0% |
| CeCl3 | KH2PO4 | Synergy and Antagonism | 14.3% | 14.3% | no | 0.0% |
| CeCl3 | LaCl3 | Synergy and Antagonism | 42.9% | 14.3% | yes | 71.4% |
| CeCl3 | Na2SiO3 | Synergy | 71.4% | 0.0% | yes | 57.1% |
| CeCl3 | Na3PO4 | Mild Synergy | 28.6% | 0.0% | no | 14.3% |
| CeCl3 | Na2MoO4 | Synergy and Antagonism | 28.6% | 28.6% | no | 28.6% |
| YCl3 | NaWO4-3WO3 | Mild Synergy | 14.3% | 0.0% | no | 0.0% |
| YCl3 | KH2PO4 | Lack of Benefit | 0.0% | 0.0% | no | 0.0% |
| YCl3 | LaCl3 | Lack of Benefit | 0.0% | 0.0% | yes | 0.0% |
| YCl3 | Na2SiO3 | Synergy and Antagonsim | 57.1% | 28.6% | no | 14.3% |
| YCl3 | Na3PO4 | Synergy and Antagonism | 14.3% | 42.9% | no | 0.0% |
| YCl3 | Na2MoO4 | Synergy and Antagonism | 28.6% | 57.1% | no | 14.3% |
| NaWO4-3WO3 | KH2PO4 | Synergy and Antagonism | 14.3% | 14.3% | no | 0.0% |
| NaWO4-3WO3 | LaCl3 | Lack of Benefit | 0.0% | 0.0% | no | 0.0% |
| NaWO4-3WO3 | Na2SiO3 | Mild Antagonism | 0.0% | 14.3% | no | 0.0% |
| NaWO4-3WO3 | Na3PO4 | Lack of Benefit | 0.0% | 0.0% | no | 0.0% |
| NaWO4-3WO3 | Na2MoO4 | Lack of Benefit | 0.0% | 0.0% | no | 0.0% |
| KH2PO4 | LaCl3 | Synergy and Antagonism | 28.6% | 14.3% | no | 28.6% |
| KH2PO4 | Na2SiO3 | Synergy and Antagonism | 14.3% | 85.7% | no | 0.0% |
| KH2PO4 | Na2MoO4 | Synergy and Antagonism | 28.6% | 28.6% | no | 0.0% |
| LaCl3 | Na2SiO3 | Mild Synergy | 42.9% | 0.0% | no | 42.9% |
| LaCl3 | Na3PO4 | Mild Antagonism | 0.0% | 42.9% | no | 0.0% |
| LaCl3 | Na2MoO4 | Synergy and Antagonism | 28.6% | 28.6% | no | 28.6% |
| Na2SiO3 | Na3PO4 | Synergy | 71.4% | 0.0% | no | 0.0% |
| Na2SiO3 | Na2MoO4 | Antagonism | 0.0% | 85.7% | no | 0.0% |
| Na3PO4 | Na2MoO4 | Synergy and Antagonism | 42.9% | 14.3% | no | 0.0% |

Synergy between the oxyanions of V, Mo, and P is noted. Molecular combinations of these oxyanions form high molecular weight supramolecular anions claimed to inhibit pitting. Investigation of these alone represents ideal application of this combinatorial analysis of the present invention.

Combinations of $NaVO_3/KH_2PO_4$ and $NaVO_3/Na_3PO_4$ when adjusted to neutral pH have, in principle, the same mix of $VO_3^-$, $PO_4^{-3}$, $HPO_4^{-2}$, and $H_2PO_4^-$. Without being bound by theory, the fact that the synergies differ suggest either the K cation influences the inhibition or kinetically determined different macromolecular species form depending on whether the neutral pH is approached from the acid side ($NaVO_3$:$KH_2PO_4$) or the basic side ($NaVO_3$:$Na_3PO_4$). The latter is most likely but its investigation remains beyond the scope of this report.

Inhibition efficiency was calculated for all inhibitors and combinations of inhibitors using the 100 mV polarization screening data. Efficiency calculations assume a uniform current density across the sample surface, but have also been applied to systems undergoing localized corrosion due to ease of calculation and need for comparison[15, 42-45]. Inhibition efficiency was calculated using the formula below:

$$\text{Inhibition efficiency } (I.E.)=[1-(I_{inhibited}/I_{uninhibited})]\times 100\%$$

Figure 10:
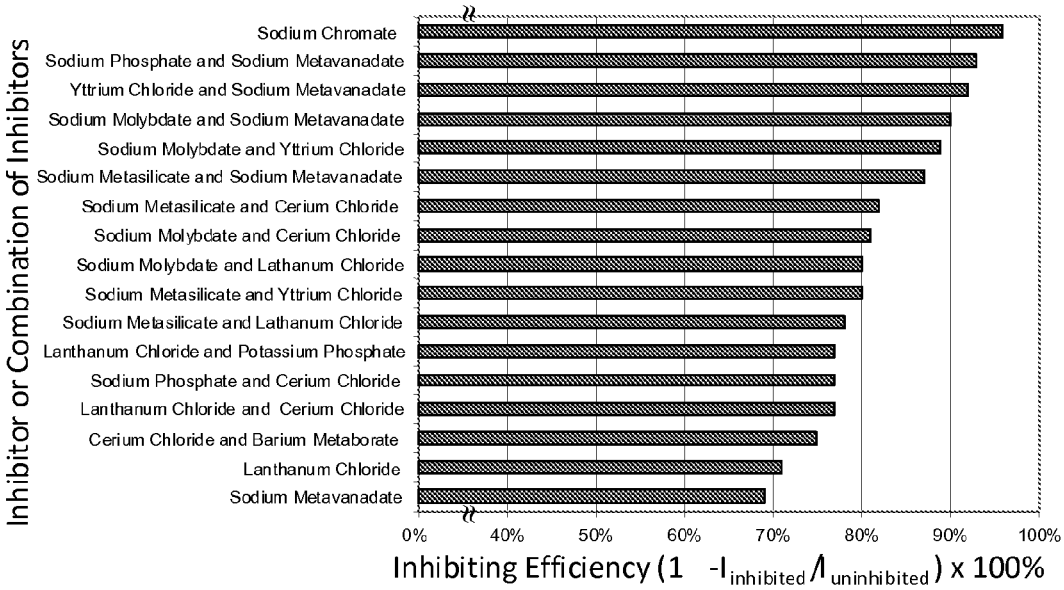
FIG. 10 is a graph showing the inhibiting efficiency of embodiments of the present invention.
Figure 14:
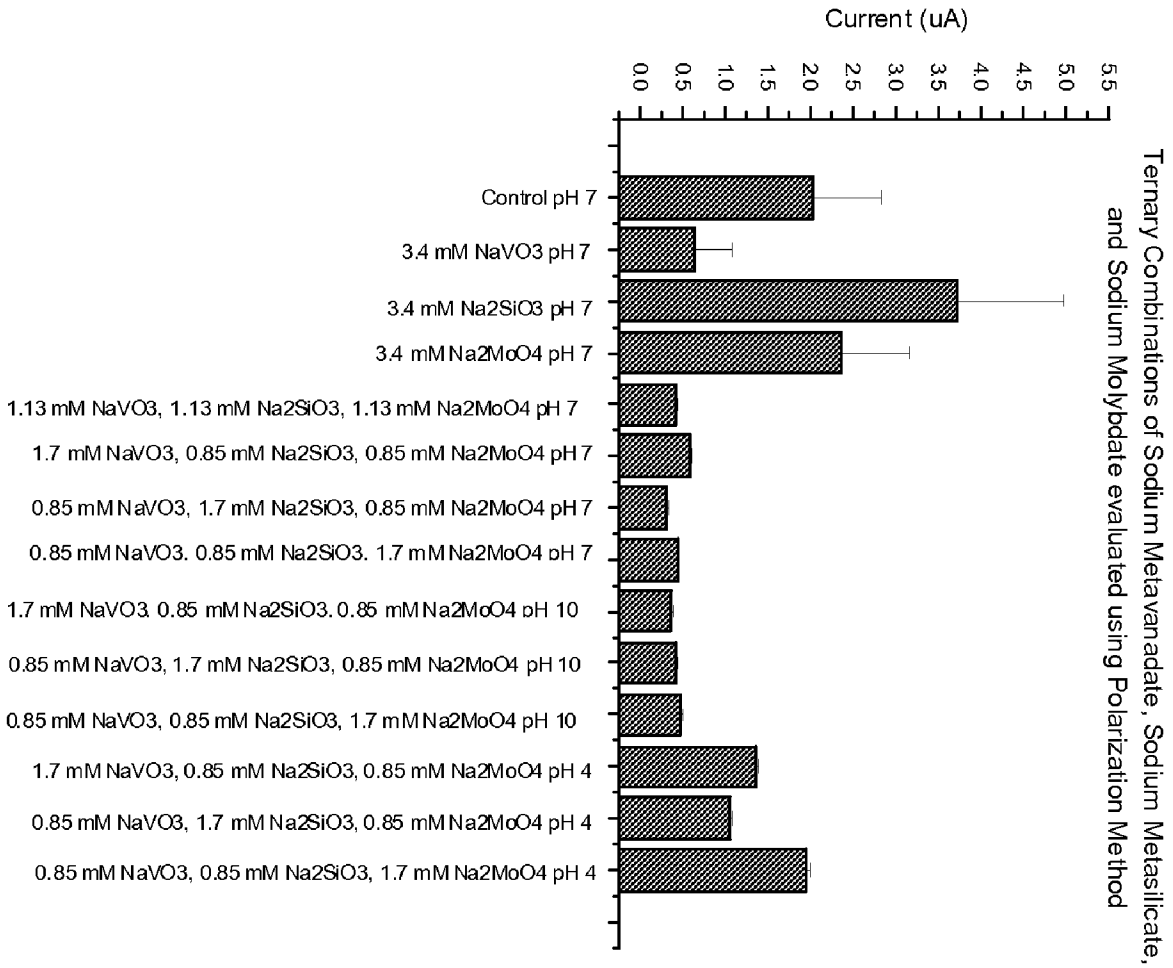
FIG. 14 is a bar chart of the corrosion currents measured for the ternary mixture of sodium metavanadate/sodium metasilicate/sodium molybdate.
Figure 15:
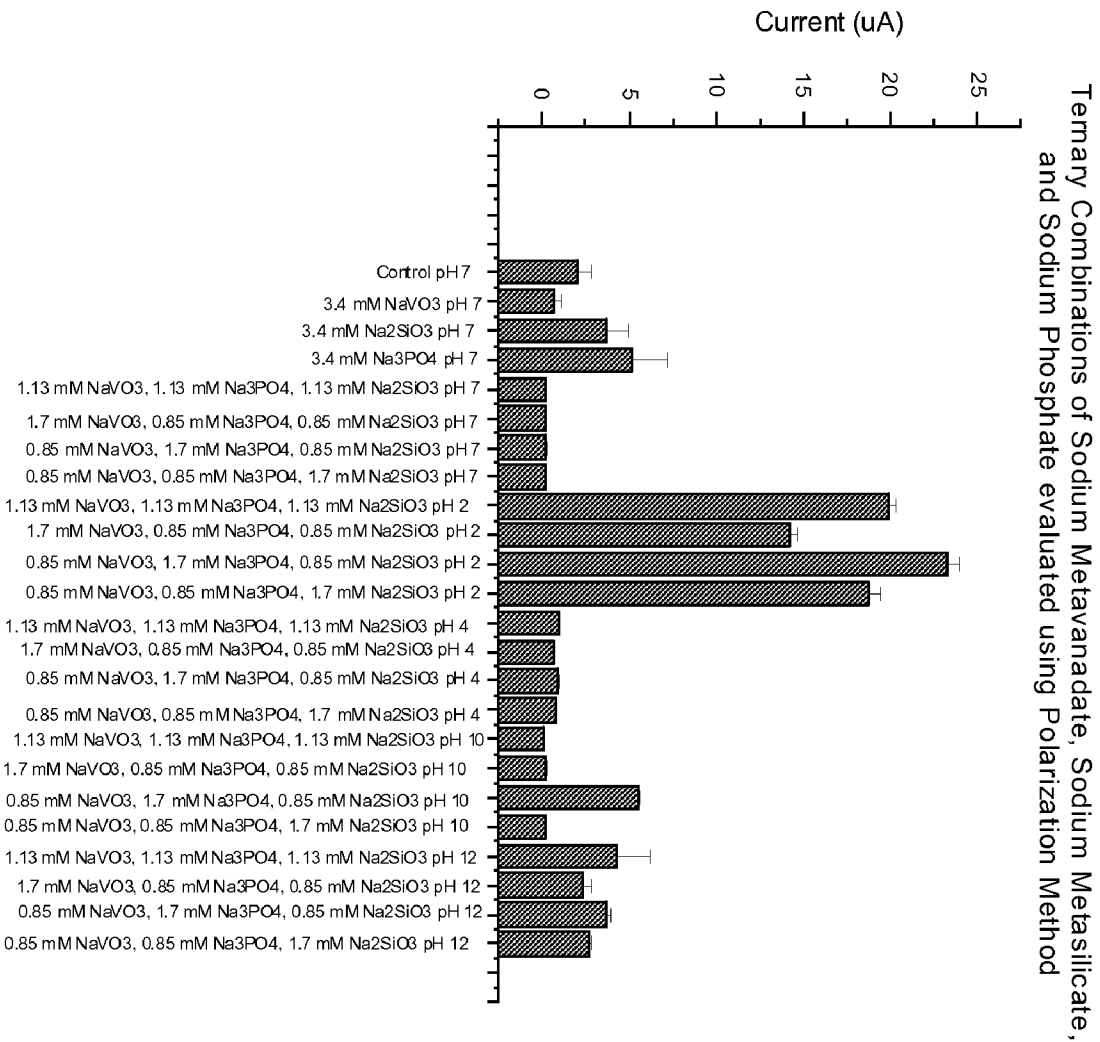
FIG. 15 is a bar chart of the corrosion currents measured for the ternary mixture of sodium metavanadate/sodium metasilicate/sodium phosphate.
Figure 16:
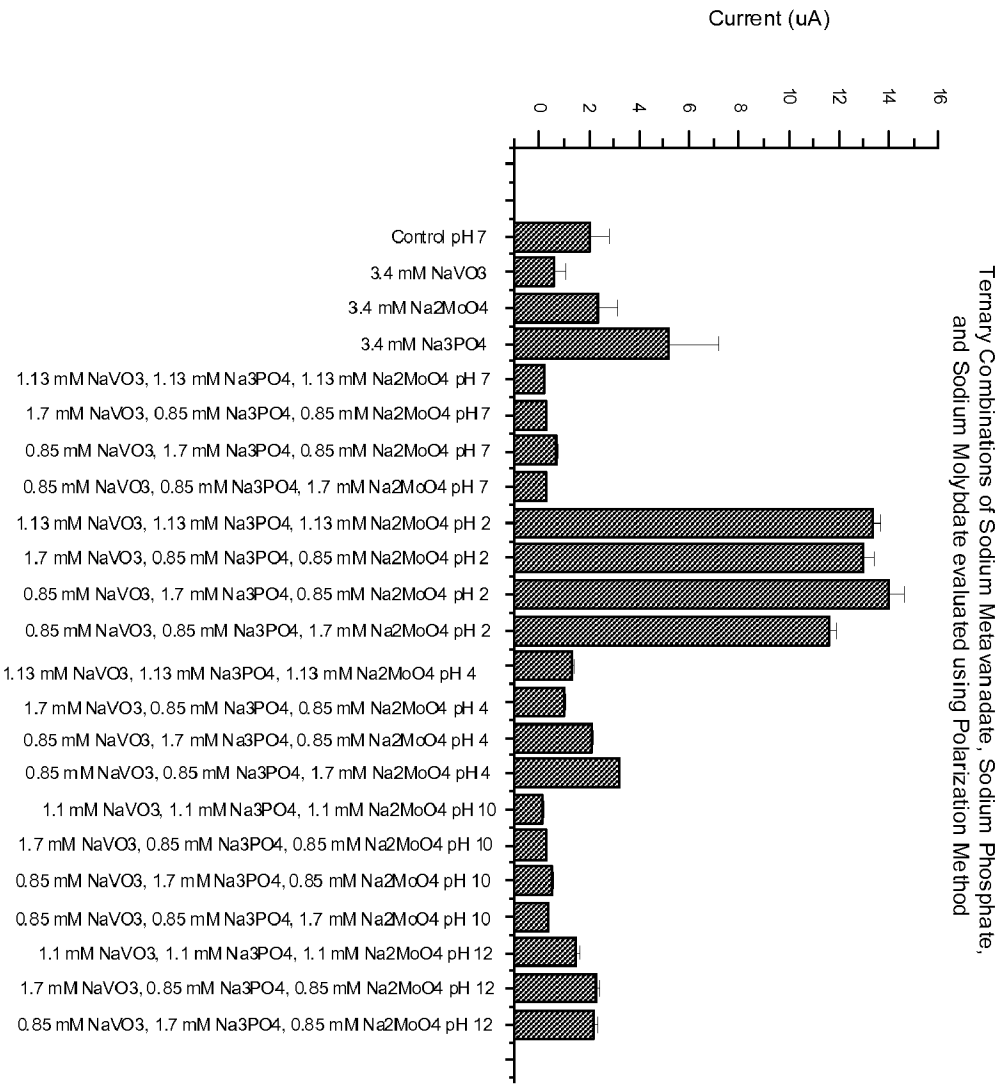
FIG. 16 is a bar chart of the corrosion currents measured for the ternary mixture of sodium metavanadate/sodium phosphate/sodium molybdate.
Figure 17:
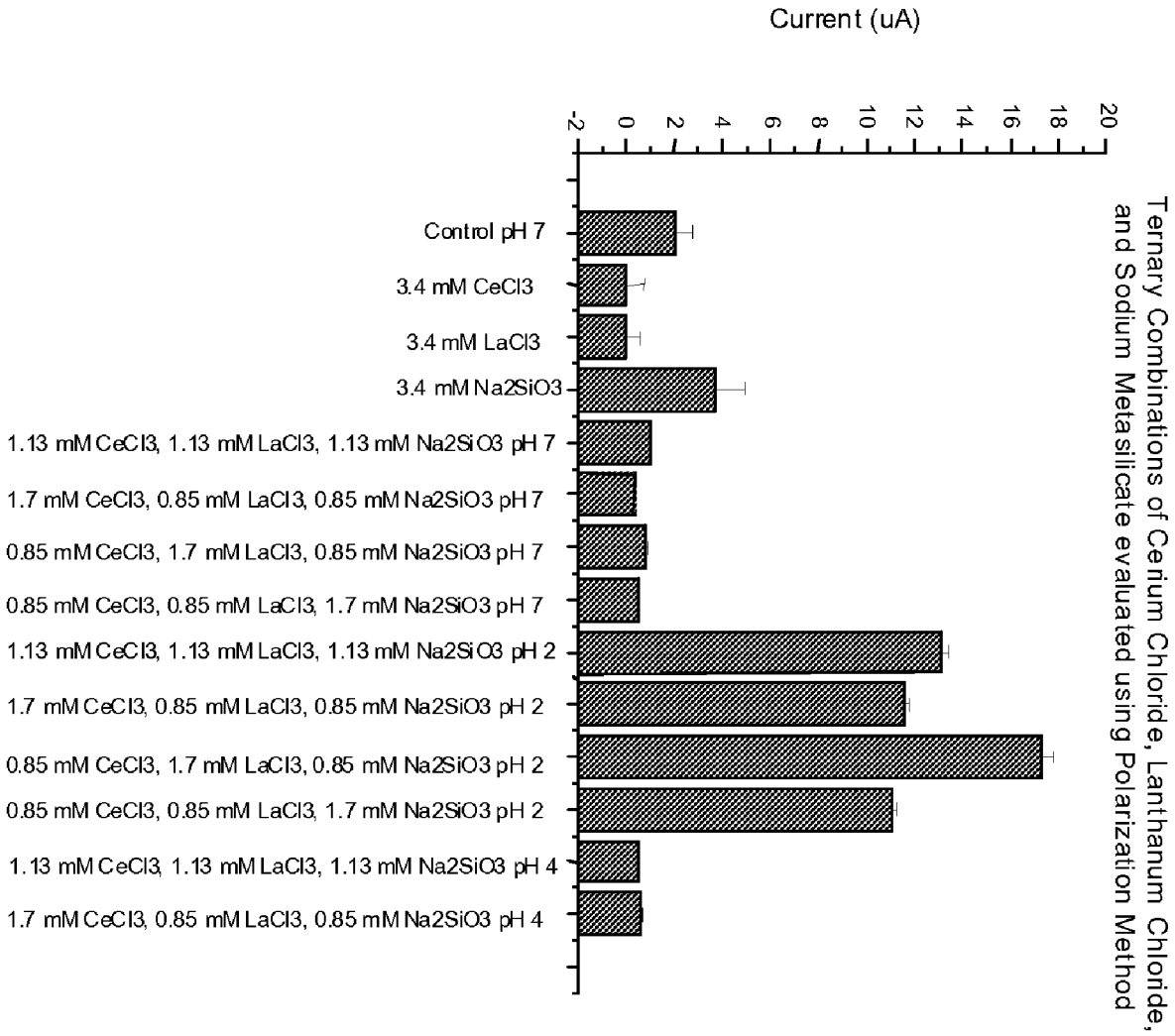
FIG. 17 is a bar chart of the corrosion currents measured for the ternary mixture of cerium chloride/lanthanum cloride/sodium metasilicate.

The best inhibiting efficiencies found in all of the inhibitors and binary combinations tested are shown in FIG. 10. The ratio with the best inhibitor efficiency was used for each combination listed. Some combinations are limited-range synergies but demonstrate strong synergy at certain ratios.

A significant advantage of the high throughput screening approach used here is the ability to survey inhibitor performance over a range of test conditions within a single experiment. The ideal inhibitor should perform well over a wide pH range, as well as temperatures. A 50 cell array was employed to test nine inhibitor ratios at pH 2, 4, 7, 10 and 12. An example of this large matrix of experiments is shown in FIG. 11 for the mixture of sodium metavanadate and sodium metasilicate. FIG. 11 shows the utility of the proposed high throughput screening method. This plot can be interpreted similarly to a phase diagram. The x axis provides information on the chemical make-up of the inhibitor. On the left side, one has a solution of 100% compound A; on the right side one has a solution of 100% compound B. The points in between the left and right are proportionally different amounts of A and B. The ionic concentration in all cases is 3.4 mM. The initial pH of the test solution is adjusted to the pH value indicated on the vertical axis. The color designates the corrosion current under the specified conditions. So depending on the inhibitor ratio and pH, different corrosion protection performance occurs. For the inhibitor combinations tested, it is clear that synergistic ratios that exist at one pH do not necessarily hold for other pHs. Synergies are clearly observed in the plot of current for 1.7 mM (50%) of each inhibitor at pH 12, and for 3.2 mM sodium metavanadate, 0.2 mM sodium metasilicate at pH 7. These results are repeatable and reinforce the need for high throuput experimentation for the discovery and characterization of corrosion inhibitors.

Evaluation of ten inhibitors for AA2024 was conducted using a 9 hour 100 mV DC bias screening method under the control of the MMA. Hours 7-9 of this test were found to exhibit stable currents that were averaged for evaluation of the inhibitors. Confidence in this 100 mV screening method was established from correlating results with corrosion resistance evaluated using electrochemical impedance on AA2024-T3. Screening of inhibitor combinations was conducted using the 100 mV DC bias screening method. Four types of inhibitor combination behavior were observed using this method; no benefit of the mixture, antagonism, synergy, and a mix of antagonism and synergy across the ratio of the mixture. Some of these mixtures showed only limited range behavior where the behavior was limited to certain ratios of the inhibitors while others exhibited broad range behavior. 44 inhibitor combinations were examined at pH 7 but the 100 mV screening method has been shown capable of examining a variety of testing conditions.

DC polarization between two AA2024 wire electrodes using a multiple-electrode testing system appears to be a suitable method for rapid screening of corrosion inhibitors and inhibitor combinations. Comparison of single inhibitor performance between the 100 mV DC bias (between two AA2024 electrodes) screening method and electrochemical impedance testing on AA2024-T3 has shown that:

- The ordinal correlation between short-term (2 hour) and long-term (10 day) electrochemical data was 100% when using 100 mV DC polarization of AA2024 wire for the inhibitors cerium chloride, yttrium chloride, sodium metatungstate and control that were the most consistent over the long-term testing
- 100 mV DC bias testing of 50 cells of independent chemistries allows high throughput for screening potential synergies between inhibitors at various ratios, pH, etc.
- Synergies between different non-chromate corrosion inhibitors at various ratios have been discovered with inhibiting efficiencies up to 93%
- The inhibiting efficiency of combinations of inhibitors varies greatly depending on pH, ratio of concentration of inhibitors, overall concentration of inhibitors, etc.
- These simple DC polarization tests may provide one avenue for the rapid discovery of effective corrosion inhibitors using combinatorial methods.

As stated above, another embodiment of the present invention is a high throughput screening method for corrosion inhibitor discovery related to cyclic voltammetry detection, including cyclic voltammetry detection of surface enhanced copper on AA2024-T.

Aluminum alloy 2024-T3 possesses a high strength to weight ratio for its use in aerospace and other commercial applications. This high strength is achieved mainly through the presence of Cu, which forms with the other alloying elements to form strengthening precipitates in the alloy. Though high strength is achieved, the difference in potentials of the copper rich precipitates allows galvanic cells to form between the precipitates and the aluminum rich matrix of the alloy. In particular, S-phase ($Al_2CuMg$) particles have been shown to be anodic compared to the open circuit potential of the AA2024-T3 matrix and are one of the primary sites of pitting corrosion in AA2024-T3.

Dissolution of S-phase particles proceeds by dealloying of the aluminum and magnesium, leaving behind nanoporous copper that detaches and is oxidized in solution and reduced back on the surface of the alloy by a mechanism described by Buchheit et. al. Observations of the dissolution of S-phase particles and localized corrosion that lead to the enrichment of copper on the surface of AA2024-T3 have been noted by many researchers. Measurement of the amount of surface copper using cyclic voltammetry has been used to assess the level of corrosion damage on AA2024-T3 exposed to various aggressive solutions. This cyclic voltammetry method for assessing surface copper on AA2024-T3 will be used in the present work to evaluate corrosion damage and inhibition in 0.6 M sodium chloride.

Related to this embodiment, aluminum alloy 2024-T3 wire (All Metal Sales), with a diameter of 1.59 mm (1/16"), was obtained for use as electrodes in electrochemical testing. The wire was cut to 2.54 cm (1") lengths and degreased by ultrasonic exposure to acetone and methanol respectively for 10 minutes each.

The AA2024-T3 electrodes were exposed to inhibitor solution (3.4 mM total inhibitor concentration, 0.6 M NaCl) by immersing 1.2 cm of the electrode in the solution. Cells of the reaction frame were filled with 1.8 mL of 3.4 mM total inhibitor in 0.6 M NaCl solution. Forty-four inhibitor combinations were tested in this stage of the screening process and were adjusted to pH 7 by addition of HCl or NaOH. Screening was performed on solutions containing 0.2 mM (5.9%), 0.7 mM (20.6%), 1.2 mM (35.3%), 1.7 mM (50%), 2.2 mM (64.7%), 2.7 mM (79.4%), and 3.2 mM (94.1%) of inhibitor A, with the balance of the 3.4 mM total inhibitor comprised of inhibitor B for all 44 inhibitor combinations. The combinations of inhibitors were comprised of the following inhibitors: sodium metavanadate, cerium chloride, barium metaborate, yttrium chloride, sodium metatungstate, potassium phosphate, lanthanum chloride, sodium metasilicate, sodium phosphate, and sodium molybdate.

96 electrodes, connected to a reaction frame lid, were immersed in 96 independent cells containing solution of a standard 8×12 reaction frame. The electrodes were exposed to the inhibitor solution, which was open to air for 24 hours. After the 24 hour exposure, the reaction frame lid housing the electrodes was disconnected from the reaction frame and the electrodes were rinsed with deionized water. The electrodes housed in the reaction frame lid were then placed in a special reaction frame setup containing pH 8.4 borate buffer (4.31, g/L $Na_2B_4O_7$+7.07 g/L $H_3BO_3$) in the cells of the reaction frame. The bottom of the reaction frame in this setup was removed by drilling so that a borate buffer agar gel (4.31 g/L $Na_2B_4O_7$+7.07 g/L $H_3BO_3$+10 g Agar) could serve as the bottom of the reaction frame and could connect each cell to a common counter and reference electrode also placed in the borate buffer agar gel.

Cyclic voltammetry was performed on the 96 electrodes using a multichannel microelectrode analyzer (MMA) (Scribner, Associates, Southern Pines, N.C.) to control the potential and record current. The MMA is a group of 10 modules of 10 zero resistance ammeters that can be used for current or potential measurement of electrodes. The modules may be changed out to allow measurement of different current ranges. The range used for these experiments allowed clear measurement between 1 nanoamp and 1 microamp. The MMA is computer controlled and is attached to the electrodes in the reaction frame by means of an adapter. The MMA also controls a common reference and counter electrode for potentiodynamic experiments. A saturated calomel electrode (0.241 V vs. NHE) and platinum mesh were used as the reference and counter electrodes in this experimental setup. A schematic diagram of the experimental setup is presented in FIG. 18.

The cyclic voltammetry was conducted by sweeping the potential from −700 $mV_{SCE}$ to 300 $mV_{SCE}$ and back to −1200 $mV_{SCE}$. The range of this sweep is in the range for copper oxidation/reduction but not for the corrosion of the base material. Three potential sweeps were conducted and the third cyclic voltammagram was used for evaluation of the copper content on each electrode surface. Prior to each sweep a potential hold at −700 $mV_{SCE}$ was performed (5 minutes prior to sweep 1, 10 minutes prior to sweep 2, and 20 minutes prior to the third and final sweep).

Examples of the present invention include DC polarization testing of samples in parallel. To show an embodiment of this method, 1.8 mL of test solution was transferred or mixed in each of 50 cells of a conventional 2 mL 8×12 reaction frame. Each cell may contain an independent test solution. Two AA2024-T3 wire electrodes were plugged into electrical contacts contained in the fabricated top for each cell, totaling 100 wire electrodes connected to the multichannel microelectrode analyzer (MMA).

The fabricated top was then placed on the reaction frame containing the chemistries of interest and the system was left open to air. Half of the electrodes, one per cell, were set to a potential 100 mV above the base potential determined by the second wire electrode of the pair. The current average was calculated using measured currents from 7 to 9 hours of DC polarization. This current average was used to quantify the corrosion protection.

For an example of the determination of Surface Copper on AA2024-T3 for Estimating Corrosion Damage, 1.8 mL of test solution was transferred or mixed in each cell (96 cells) of a conventional 2 mL 8×12 reaction frame. Each cell may contain an independent test solution. One AA2024-T3 wire electrode was plugged into an electrical contact contained in the fabricated top for each cell, totaling 96 wire electrodes connected to the multichannel microelectrode analyzer (MMA).

The fabricated top was then placed on the reaction frame containing the chemistries of interest and the system was left open to air. After an exposure time (e.g., 24 hours), the reaction frame lid holding the electrodes was removed from the reaction frame, and the electrodes were rinsed with deionized water. The electrodes, still held in the reaction frame lid, were then placed into a special reaction frame modified for conducting cyclic voltammetry on the electrodes in parallel.

As an example of the setup for the special reaction frame—For this special reaction frame, a hole was drilled into the bottom of each well of a standard 8×12 reaction frame. The reaction frame was then partially immersed into a borate buffer agar gel (4.31 g/L $Na_2B_4O_7$+7.07 g/L $H_3BO_3$+10 g/L Agar). This gel provided ionic continuity between each well and a universal counter and reference electrode also immersed into the gel. After solidification of the agar gel, each well was filled with 1.2 mL of pH 8.4 borate buffer (4.31 g/L $Na_2B_4O_7$+7.07 g/L $H_3BO_3$). A cyclic voltammetry was conducted by sweeping the potential at a rate of 1 mV/s from −700 $mV_{SCE}$ to 300 $mV_{SCE}$ and back to −1200 $mV_{SCE}$. Prior to each sweep, a potential hold at −700 $mV_{SCE}$ was performed (5 minutes prior to sweep #1, 10 minutes prior to sweep #2, and 20 minutes prior to the third and final sweep). Three potential sweeps were conducted, and the third cyclic voltammogram was used for quantifying the amount of copper on each electrode surface. The extent of corrosion for any given test solution was estimated by the height of the first oxidation peak ($Cu \rightarrow Cu^+$).

Figure 18:
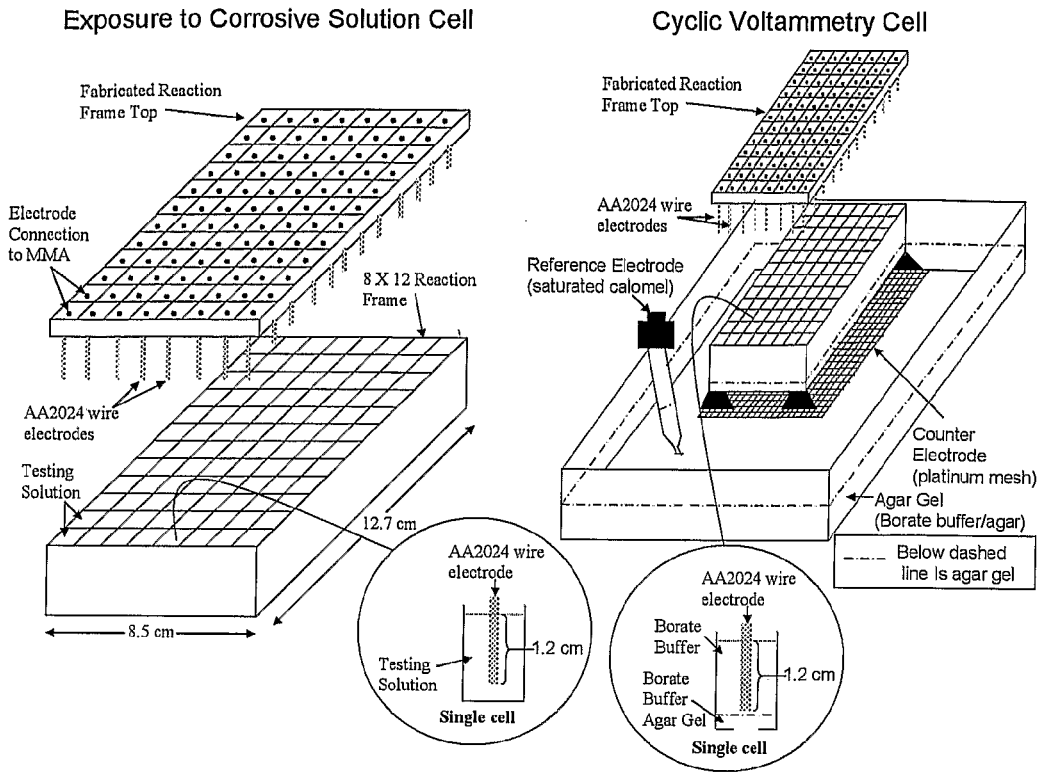
FIG. 18 shows an example of the high throughput methods of the present invention.

A schematic of this embodiment is shown as FIG. 18.

Another embodiment of the present invention is related to fluorometric assessment of corrosion products, including fluorometric assessment of corrosion products of AA2024-T3 for high throughput screening of corrosion inhibitors AA2024-T3 consists of approximately 93% Al. Al is the primary constituent involved in dissolution of the alloy in corrosive solutions. The corroded aluminum typically takes the form of aluminum oxide or aluminum hydroxide. While some of the corrosion products adhere to the surface of the alloy, the rest dissolve in the surrounding solution. Detection of the amount of aluminum in solution may be carried out through the use of a fluorescent dye sensitive to the presence of aluminum. Lumogallion is one such dye that is sensitive to aluminum ions and has a limited number of interferences from other ions. Lumogallion has been shown to be sensitive to aluminum in solution resulting from the corrosion of AA2024-T3. See Sibi, M. P., Zong, Z., "Determination of corrosion of aluminum alloy under protective coatings using fluorescent probes," *Progress in Organic Coatings* 47, 8-15 (2003).

Estimation of the extent of aluminum dissolution of an aluminum alloy in the presence of aggressive ions and corrosion inhibitor species is another high throughput screening method for determining the efficacy of inhibitor species.

Related to this embodiment, a Spectramax M2 Plate Reader was used to carry out fluorescence detection of lumogallion solutions. All fluorescence detection of solutions was carried out using a 96 well, costar black clear bottom plate for optical assay. Optimization of the excitation and emission was performed and the optimum values were determined to be 491 nm excitation wavelength and 610 nm emission wavelength. A 590 nm wavelength cutoff filter was employed by the instrument to reduce signal from the excitation source in the emission measurement. Solutions containing different concentrations of aluminum up to 39.2 μM aluminum chloride, 51.1 μM lumogallion, and 0.2 M sodium acetate buffer (pH 5.2) were tested to verify the sensitivity of lumogallion fluorescence to the presence of aluminum.

Sensitivity of lumogallion fluorescence to other species of interest in exposure experiments on AA2024-T3 was then carried out. The species of interest included chloride (aggressive ion) and possible inhibitor species: sodium metavanadate, cerium chloride, barium metaborate, yttrium chloride, sodium metatungstate, potassium phosphate, lanthanum chloride, sodium metasilicate, sodium phosphate, sodium molybdate, europium chloride, gadolinium chloride, and neodymium chloride. Solutions of 0.03 M NaCl, 51.1 μM lumogallion, 0.2 M sodium acetate buffer (pH 5.2), and concentrations of $AlCl_3$ varying from 0 to 32.66 μM were tested for fluorescence emission. Solutions of single inhibitors and binary combinations of inhibitors were tested at 0.17 mM total inhibitor concentration according to the following combinations: component A tested at 0.01 mM, 0.035 mM, 0.06 mM, 0.085 mM, 0.11 mM, 0.135 mM, and 0.16 mM with balance of the 0.17 mM total comprised of component B. The test solution comprised of 0.17 mM total inhibitor, 0.03 M NaCl, 51.1 μM lumogallion and 0.2 M sodium acetate buffer (pH 5.2).

AA2024-T3 electrodes were exposed to inhibitor solution (3.4 mM total inhibitor concentration, 0.6 M NaCl) by immersing 1.2 cm of the electrode in the solution. Cells of the reaction frame were filled with 1.8 mL of 3.4 mM total inhibitor in 0.6 M NaCl solution. Desired pH of the solutions was obtained by addition of HCl or NaOH prior to exposure. Screening was performed on solutions containing 0.2 mM (5.9%), 0.7 mM (20.6%), 1.2 mM (35.3%), 1.7 mM (50%), 2.2 mM (64.7%), 2.7 mM (79.4%), and 3.2 mM (94.1%) of inhibitor A with the balance of the 3.4 mM total inhibitor comprised of inhibitor B. The combinations of inhibitors were comprised of the following inhibitors: sodium metavanadate, cerium chloride, barium metaborate, yttrium chloride, sodium metatungstate, potassium phosphate, lanthanum chloride, sodium metasilicate, sodium phosphate, sodium molybdate, europium chloride, gadolinium chloride, and neodymium chloride.

96 electrodes, connected to a reaction frame lid, were immersed in 96 independent cells containing solution of a standard 8×12 reaction frame. The electrodes were exposed to the inhibitor solution, which was open to air, for 24 hours. After the 24 hour exposure, the reaction frame lid housing the electrodes was disconnected from the reaction frame and the remaining solution was acidified to ensure dissolution of any aluminum containing deposits that had precipitated from solution during the exposure period.

The resulting test solution was then mixed with acetate buffer and lumogallion to obtain the desired fluorometric assay solution. 0.1 mL of the test solution was added to 1.8 mL 0.2 M sodium acetate buffer (pH 5.2) and 0.1 mL 1.02 mM lumogallion. The resulting solution was 0.17 mM total inhibitor, 0.03 M NaCl, 0.19 M sodium acetate buffer, 51.1 μM lumogallion and an unknown concentration of aluminum that was 5% of that resulting from the previous exposure. 200 μL of this fluorometric solution was then transferred into our fluorometric assay plate for quantification of emission from the solution.

As an example of the determination of Aluminum Concentration for Estimating Corrosion Damage in AA2024-T3 Samples Tested in Parallel, 1.8 mL of test solution was transferred or mixed in each cell (96 cells) of a conventional 2 mL 8×12 reaction frame. Each cell may contain an independent test solution. One AA2024-T3 wire electrode was plugged into an electrical contact contained in the fabricated top for each cell, totaling 96 wire electrodes connected to the multichannel microelectrode analyzer (MMA). The fabricated top was then placed on the reaction frame containing the chemistries of interest and the system was left open to air.

After an exposure time (e.g., 24 hours), the reaction frame lid holding the electrodes was removed from the reaction frame, and the test solutions contained in the reaction frame were each dosed with HCl drop wise. The resulting test solution was mixed with acetate buffer and fluorescent dye (lumogallion or morin) to obtain the desired fluorometric assay solution. Typical test solutions were diluted by taking 100 μL test solution and adding to it 100 μL 1.02 mM lumogallion or 200 μL 510 μM morin and the balance 0.2 M sodium acetate buffer to reach 2 mL of total solution. The resulting solution was 0.17 mM total inhibitor, 0.03 M NaCl, 0.19 M sodium acetate buffer, 51 μM lumogallion or morin and an unknown concentration of aluminum that was 5% of that resulting from the previous exposure. Further dilutions included 5 μL, 25 μL, and 50 μL test solution with the remainder of the 100 μL added in 0.6 M NaCl to maintain a consistent [$Cl^-$] of 0.03 M in the fluorescence assay.

200 μL of this fluorometric solution was then transferred into a fluorometric assay plate for quantification of emission from the solution. The emission of lumogallion fluorometric solutions was determined using a 491 nm excitation wavelength, a 590 nm cutoff filter, recording at a 610 nm emission wavelength. The emission of morin fluorometric solutions was determined using a 418 nm excitation wavelength, a 495 nm cutoff filter, recording at a 517 nm emission wavelength.

Aluminum concentration was determined by calculation from the emission and the calibration curves for each fluorescent dye. Standard deviations in the aluminum concentrations were estimated by taking the positive standard deviation in the emission value and determining the aluminum concentration at that value.

Another embodiment of the present invention is methods of coating a substrate with the materials described herein in sequential order. Examples of this embodiment are shown in FIGS. 19-24. The sequenced exposure of a metal to the relevant chemical species can provide even greater benefit and even more unexpected results that their simultaneous combination. That is, if compound A is placed in one container and compound B (and C, etc. ) is placed in another container, and then the metal is exposed to compound A and then B, or B and then A, or exposed multiple times, a very beneficial results can be obtained.

Figure 19:
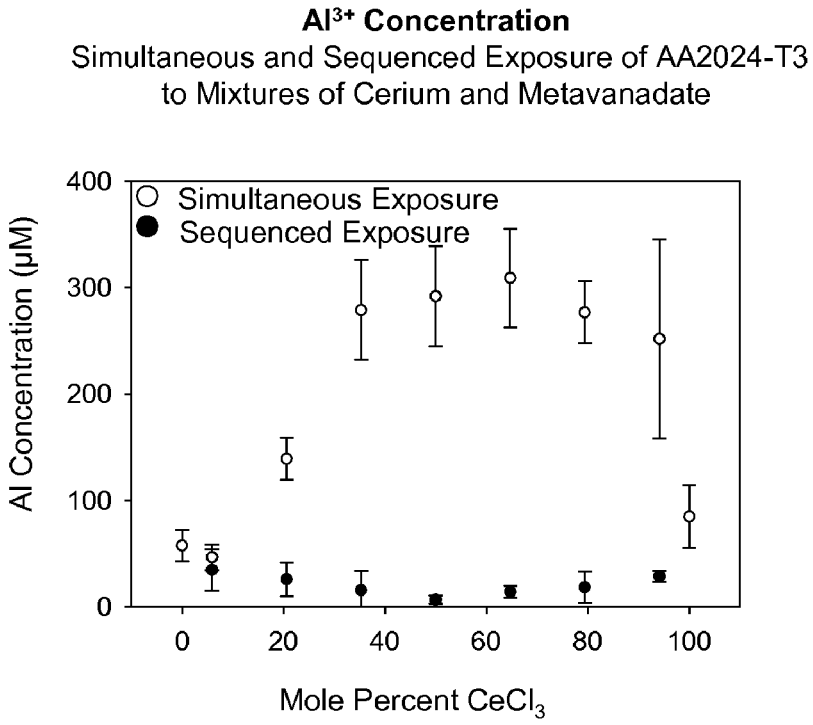
FIGS. 19-24 show coating examples of the present invention, including a substrated sequenced exposure of components of the compositions of the present invention.
Figure 21:
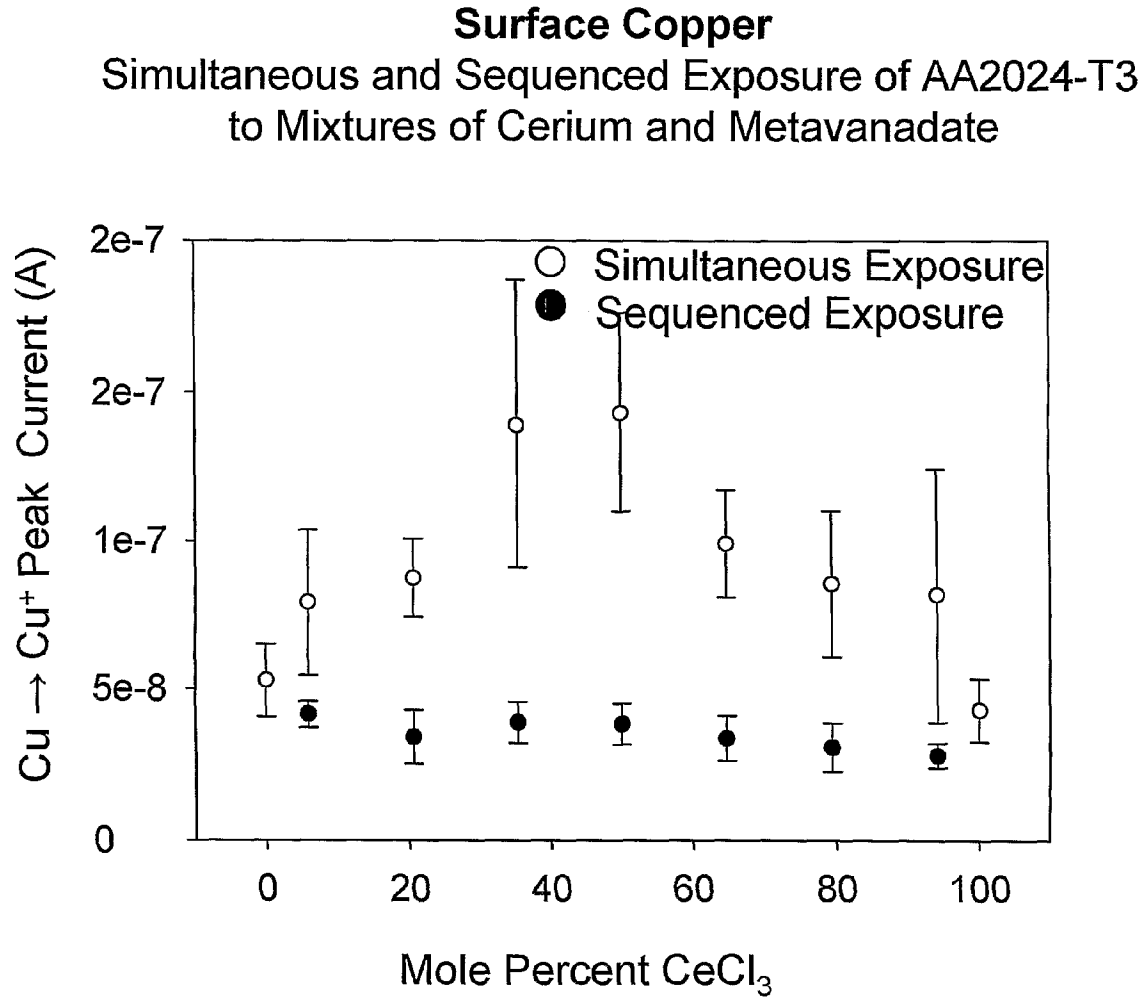
Figure 23:
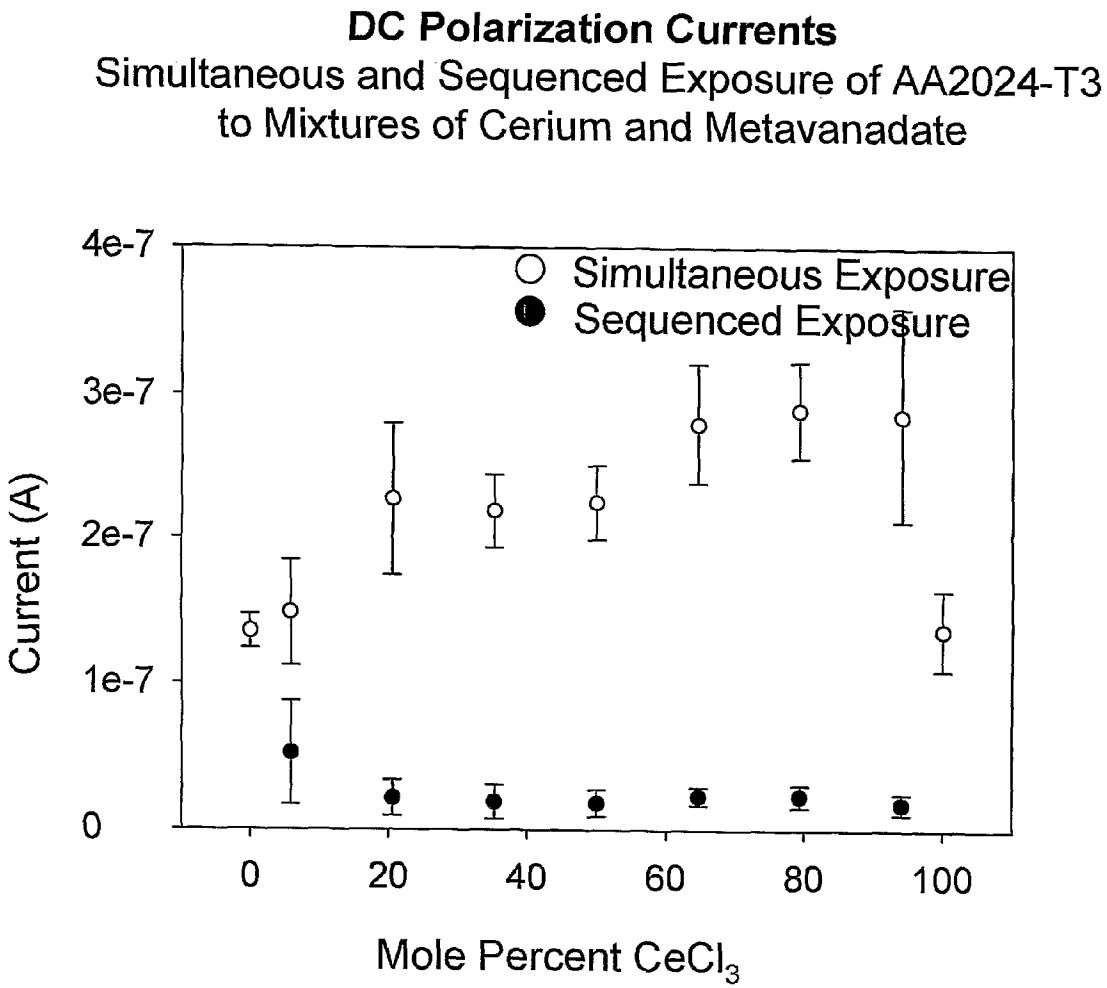

In FIGS. 19, 21, and 23, AA2024-T3 samples were exposed to cerium ions and metavanadte ions in either a simultaneous fashion where the ions existed together in the same bath, or sequentially where cerium ions were in one bath and metavanadate ions were in another. In the simultaneous experiments, the total molar concentration was always maintained to 3.4 mM.

In the sequenced exposure, again, the molar concentration always totaled 3.4 mM. If the cerium content was 1.7 mM, then the metavanadate concentration was 1.7 mM.

Figure 3:
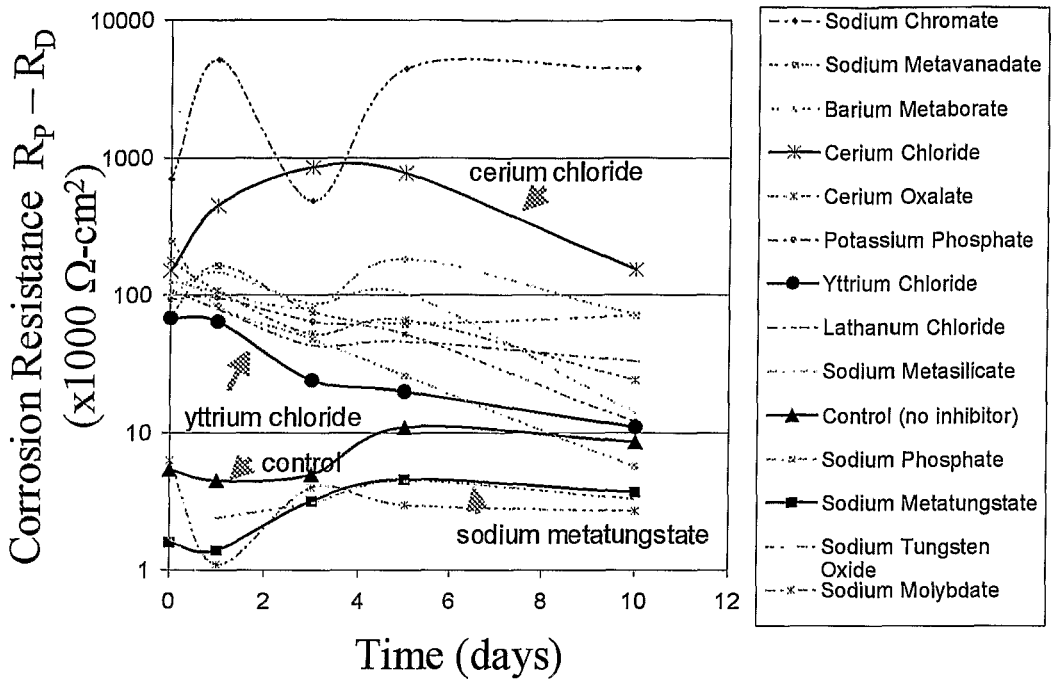
FIG. 3 shows corrosion resistance versus time as determined by EIS (electrochemical impedance spectroscopy) of AA2024-T3 sheet in 3.4 mM inhibitor+0.6 M NaCl solution adjusted to pH 7.[8,26]

The horizontal axis of the figures is the mole percent of cerium in the mixture. The vertical axis is the measured quantity to determine the extent of corrosion. FIG. 19 shows the result for aluminum ions released. FIG. 3 shows the amount of surface copper. FIG. 23 shows the DC current passed upon 100 mV polarization. In each case, larger values indicate more corrosion.

As can be seen in FIG. 19, 21, and 27, the sequenced exposure of AA2024-T3 to cerium and metavanadate shows dramatic improvement in the corrosion protection provided by these materials. The sequenced exposure is synergistic at all conditions. More importantly, this result is unpredictable, since the simultaneous combination of these compounds results in an antagonistic interaction, just the opposite of what is observed by the sequenced exposure.

Figure 20:
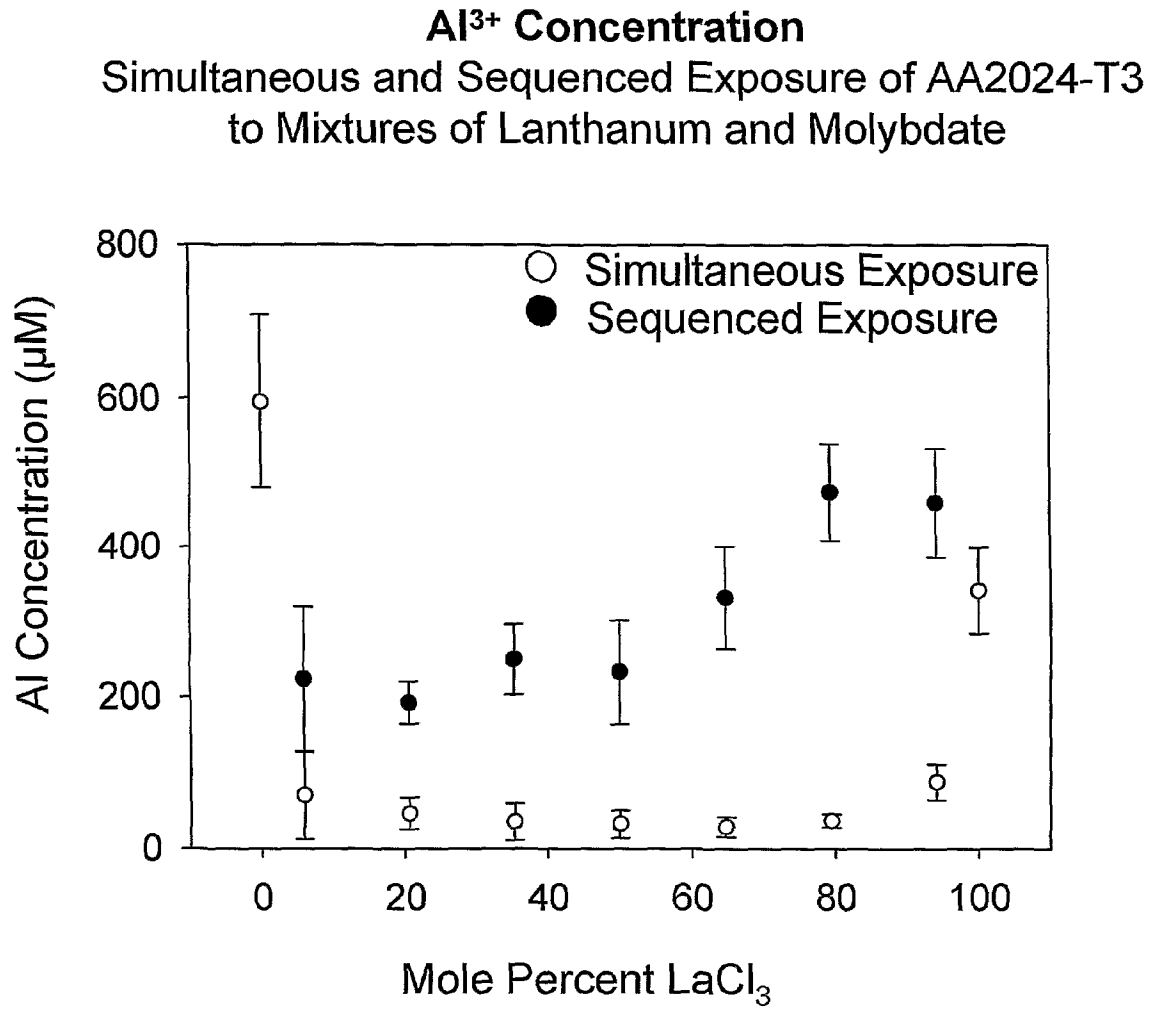
Figure 22:
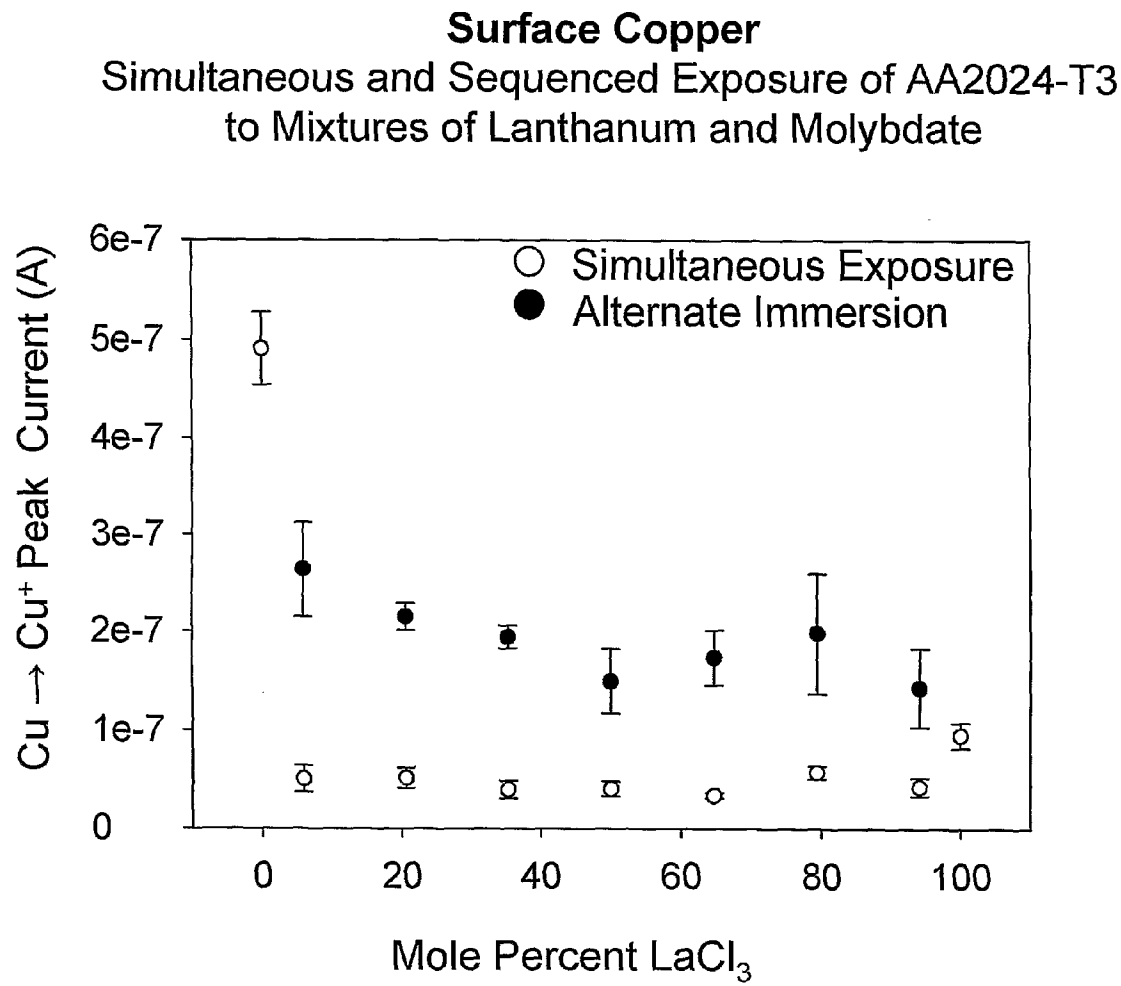
Figure 24:
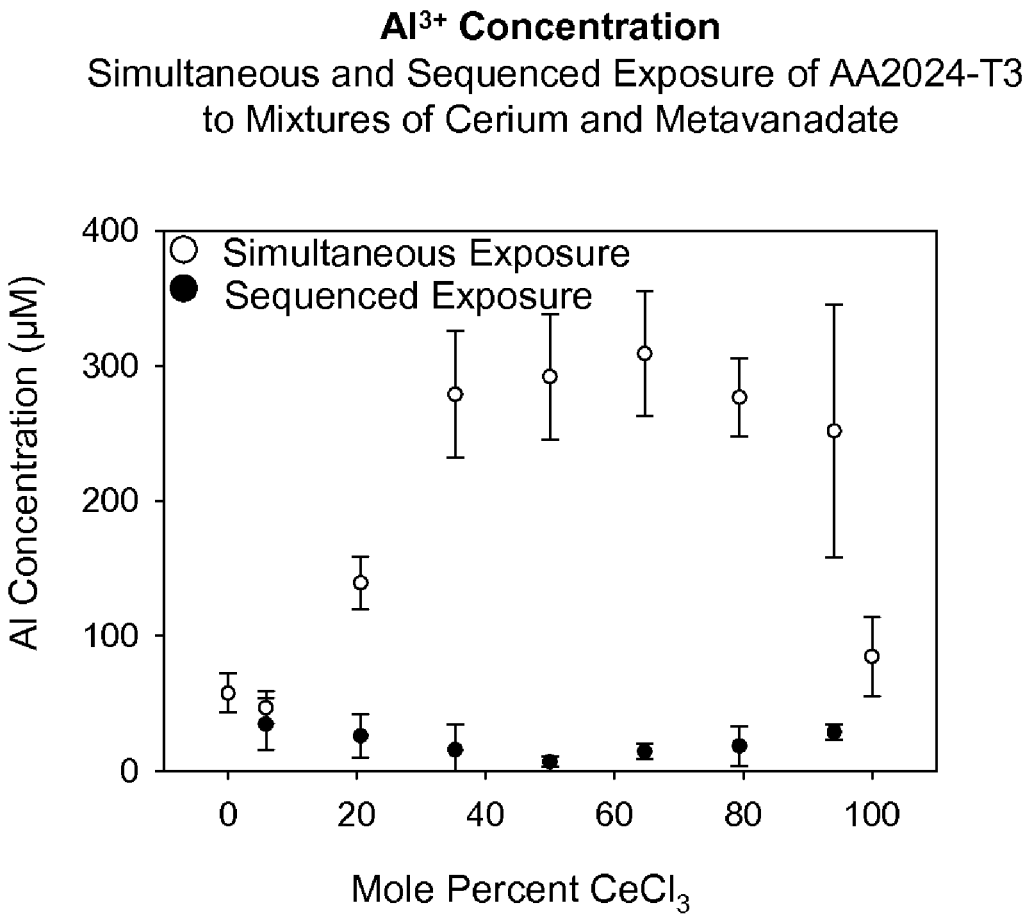

In FIGS. 20, 22, and 24, AA2024-T3 samples were exposed to lanthanum ions and molybdate ions in either a simultaneous fashion where the ions existed together in the same bath, or sequentially where lanthanum ions were in one bath and molybdate ions were in another. In the simultaneous experiments, the total molar concentration was always maintained to 3.4 mM. In the sequenced exposure, again, the molar concentration always totaled 3.4 mM. If the lanthanum content was 1.7 mM, then the molybdate concentration was 1.7 mM.

The horizontal axis of the figures is the mole percent of lanthanum in the mixture. The vertical axis is the measured quantity to determine the extent of corrosion. FIG. 20 shows the result for aluminum ions released. FIG. 4 shows the amount of surface copper. FIG. 24 shows the DC current passed upon 100 mV polarization. In each case, larger values indicate more corrosion. As can be seen in FIGS. 20, 22, and 24, the sequenced exposure of AA2024-T3 to lanthanum and molybdate shows very different results in the corrosion protection provided by these materials. The sequenced exposure is antagonistic at all conditions. This result is not predicted, since the simultaneous combination of these compounds results in a synergistic interaction.

REFERENCES

Throughout this application, and including the list below, various publications are referenced. All such publications are incorporated by reference herein in their entirety.

M. Stern, *J. Electrochem. Soc.* 24:787-806 (1958).

D. Bienstock and H. Field, *Corrosion,* 17:87-90 (1961).

N. R. Whitehouse, *Polymer Paint and Colour J.* 178:239 (1984).

J. Boxall, *Polymers, Paints and Colour J.* 174:382-384 (1984).

D. Bienstock and J. H. Field, *Corrosion* 17:87-90 (1961).

B. R. W. Hinton, *Metal Finishing* September '91, October '91, 55-61, 15-20 (1991).

H. E. Hager, C. J. Johnson, K. Y. Blohowiak, C. M. Wong, J. H. Jones, S. R. Taylor, R. L. Cook, Jr., U.S. Pat. No. 5,866,652 (The Boeing Company, U.S.A., 1999).

R. L. Cook and S. R. Taylor, *Corrosion* 56:321-333 (2000).

Y. Feng, K. S. Siow, K. T. Teo, and A. K. Hsieh, *Corr. Sci.* 41:829-852 (1999).

S. Sayed Azim, S. Muralidharan S. V. Iyer, B. Muralidharan, and T. Vasudevan, *Br. Corr. J.* 33:297 (1998).

M. Mustafa. S. M. Shahinoor, and I. Dulal, *Br. Corrosion J.* 32:133-137 (1997).

S. Sayed Azim, S. Muralidharan, S. Venkatkrishna Iyer, *J. of Appl. Electrochem.* 25:495-500 (1995).

D. D. N. Singh and A. K. Dey, *Corrosion* 49:594-600 (1993).

M. A. Quraishi, J. Rawat, and M. Ajmal, *Corrosion* 55:919-923 (1999).

G. N. Mu, T. P. Zhao, and T. Gu, *Corrosion* 52:853-856 (1996).

M. A. Quraishi, S. Ahmed, and M. Ansari, *Br. Corrosion J.* 32, 297-300 (1997).

J. M. Abd El Kader, A. A. Warraky, and A. M. Abd El Aziz, *Br. Corr. J.* 33:152-157 (1998).

S. Rajendran, B. V. Apparao, and N. Palaniswamy, *Electrochem. Acta* 44:533-537 (1998).

T. Suzuki, H. Nishihara, and K. Aramaki, *Corr. Sci.* 38:1223-1234 (1996).

Y. Gonzalez, M. C. LaFont, N. Pebere, and F. Moran, *J. of Appl. Electrochem.* 26:1259-1265 (1996).

Y. Feng, K. S. Siow, W. K. Teo, K. L. Tan, and A. K. Hsieh, *Corrosion* 53:546-555 (1997).

S. Gonzalez, M. M. Laz, R. M. Souto, R. C. Salvarezza, and A. J. Arvia, *Corrosion* 49:450-456 (1993).

K. T. Carron, M. L. Lewis, J. Dong, J. Ding, G. Xue, and Y. Chen, *J. Matl. Sci.* 28:409-4103 (1993).

K. Aramaki and N. Hackerman, *J. Electrochem. Soc.* 116: 558 (1969).

N. Shikai and L. Yefen, Study of the Synergy Mech. of Acidic Inh., 8th Europ. Symp. on Corr. Inh. (1995).

S. A. Hodges, W. A. Uphues, and M. T. Tran, *Surf. Coatings Australia* 34: 24-30 (1997).

A. T. Evans, J. D. Scantlebury, and L. M. Callow, The Adhesion and Corrosion of Chromate Cont. Coatings on Al, J. D. Scantlebury, and M. W. Kendig, Ed., Adv. In Corr. Prot. By Org. Coatings II (ECS, Pennington, N.J., 1995).

R. L. Cook, Jr. M.S., University of Virginia (1995).

S. R. Taylor, An Examination of Possible Synergy Between Paired Combinations of Transition and Rare Earth Metal Salts, 197th Meeting of the ECS, Toronto, CAN (ECS, Pennington N.J., 2000).

E. W. MacFarland and W. H. Weinberg, *Trends in Biotechnology* 17:107-115 (1999).

B. Jandeleit, D. J. Schaefer, T. S. Powers, et. al., *Angew. Chem. Intl. Ed.* 38:2494 (1999).

J. C. Meredith, A. Karim, and E. J. Amis, *Macromolecules* 33 (2000).

J. J. Hank, *J. Mater. Sci.* 2:964-971 (1970).

Maria Posada, L. E. Murr, C. S. Niou, D. Roberson, D. Little, Roy Arrowood, and Debra George, Exfoliation and Related Microstructures in 2024 Aluminum Body Skins on Aging Aircraft, *Materials Characterization* 38: 259-272 (1997).

K. Aramaki and N. Hackerman, *J. Electrochem Soc.* 116, 568 (1969).

K. Aramaki, M. Hagiwara, and H. Nishihara, *Corros. Sci.* 27, 487 (1987).

T. Suzuki, H. Nishihara, and K. Aramaki, *Corros. Sci.* 38, 1223 (1996).

M. A Quraishi, J. Rawat, and M. Ajmal, *Corrosion* 55, 919 (1999).

S. Syed Azim, S. Muralidharan, S. Venkatakrishna Iyer, *J. Applied Electrochem.* 25, 495 (1995).

S. Syed Azim, S. Muralidharan, S. Venkatakrishna Iyer, B. Muralidharan, T. Vasudevan, *British Corrosion Journal* 33, 297 (1998).

Kendig, Martin, US Patent Application 20030019391.

W. A. Badawy, F. M. Al-Kharafi, and A. S. El-Azab, Electrochemical behaviour and corrosion inhibition of Al, Al-6061 and Al_Cu in neutral aqueous solutions, Corrosion Science 41 (1999) 709-727.

Sayed S. Abdel, Hamdi H. Hassan and Mohammed A. Amin, Corrosion and corrosion inhibition of Al and some alloys in sulphate solutions containing halide ions investigated by an impedance technique, Applied Surface Science 187 (28 Feb. 1999) 279-290.

M. A. Arenas, A. Conde, and J. J de Damborenca, Cerium: A suitable green inhibitor for tinplate, Corrosion Science 44 (2002) 511-520.

H. B. Shao, J. M. Wang, Z. Zhang, J. Q. Zhang, and C. N. Cao, The cooperative effect of calcium ions and tartrate ions on the corrosion inhibition of pure aluminum in an alkaline solution, Materials Chemistry and Physics 77 (2002) 305-309.

R. G. Buchheit, R. P. Grant, P. F. Hlava, B. Mckenzie, and G. L. Zender, "Local Dissolution Phenomena Associated with S Phase ($Al_2CuMg$) Particles in Aluminum Alloy 2024-T3," *J Electrochem. Soc.* 144, No. 8, Aug. 1997.

G. S. Chen, M. Gao, R. P. Weir, "Microconstituent-Induced Pitting Corrosion in Aluminum Alloy 2024-T3," *Corrosion,* 52, No 1, Jan. 1996, 8-15.

R. G. Buchheit, M. A. Martinez, and L. P. Montes, "Evidence for Cu Ion Formation by Dissolution and Dealloying the $Al_2CuMg$ Intermetallic Compound in Rotating Ring-Disk Collection Experiments," *J. Electrochem. Soc.* 147, (1) 119-124 (2000).

N. Dimitrov, J. A. Mann, and K. Sieradski, "Copper Redistribution during Corrosion of Aluminum Alloys," *J. Electrochem. Soc.* 146, (1) 98-102 (1999).

Alison J. Davenport and Bin Liu, "Copper Accumulation during Cleaning of Al—Cu Alloys," Electrochemical Society Proceedings, Vol. 2000-23, p. 41-46

D. A. Little, J. R. Ferrell, and J. R. Scully, "The Effect of Pretreatment and Temper on the Under-Paint Corrosion of AA2024", Corrosion/2004, paper no. 04277, NACE, Houston, Tex. (2004)

D. A. Little and J. R. Scully, "The Effect of Alloy Composition and Pretreatment on the Under-Paint Corrosion of Copper Bearing Aluminum Alloys," in Proceedings of the 2003 Tri-Service Corrosion Conference, Organized by AFOSR/AFRL (Tri-Services Committee on Corrosion, U.S. Department of Defense), Las Vegas, Nev., Nov. 17-21, 2003.

D. A. Little, M. A. Jakab, and J. R. Scully, "The Effect of Pretreatment on the Under-Paint Corrosion of AA2024-T3 at Various Temperatures," *Corrosion*, (submitted).

M. A. Jakab, F. Presuel-Moreno, and J. R. Scully, "Critical Concentrations Associated with Cobalt, Cerium, and Molybdenum Inhibition of AA2024-T3: Delivery from Al—Co—Ce(—Mo) Alloys," *Corrosion* (in press).

The invention thus being described, it will be apparent to those skilled in the art that various modifications and variations can be made in the present invention without departing from the scope or spirit of the invention. All such modifications and variations are included in the scope of this invention. As one specific example, aluminum alloy 2024 is discussed for exemplary purposes only, and should not be construed as being limiting of the present invention.

Unless otherwise indicated, all numbers expressing quantities of ingredients, properties such as reaction conditions, and so forth used in the Specification and Claims are to be understood as being modified in all instances by the term "about." Accordingly, unless indicated to the contrary, the numerical parameters set forth in the Specification and Claims are approximations that may vary depending upon the desired properties sought to be determined by the present invention.

Notwithstanding that the numerical ranges and parameters setting forth the broad scope of the invention are approximations, the numerical values set forth in the experimental or example sections are reported as precisely as possible. Any numerical value, however, inherently contain certain errors necessarily resulting from the standard deviation found in their respective testing measurements.

We claim:

1. An anti-corrosive composition, comprising a mixture of at least one of the following combinations (a)-(i) or a product resulting from a mixture of at least one of the following combinations:

(a): sodium metavanadate, sodium metasilicate, sodium phosphate;

(b): sodium metavanadate, sodium phosphate, sodium molybdate;

(c): barium metaborate and sodium metatungstate;

(d): barium metaborate and sodium metasilicate;

(e): yttrium chloride and potassium phosphate;

(f): yttrium chloride and sodium phosphate;

(g): sodium metatungstate and potassium phosphate;

(h): potassium phosphate and lanthanum chloride; and (i): lanthanum chloride and sodium phosphate.

2. A method of coating a metal or metal alloy substrate, comprising exposing the metal or metal alloy substrate to a first composition that comprises at least one of the following materials: vanadates, molybdates, tungstates, silicates, borates, Ce cations, Y cations, La cations, Eu cations, Gd cations, Nd cations; and followed by exposing the metal or metal alloy substrate to a second composition that comprises one of the following materials: vanadates, molybdates, tungstates, silicates, borates, Ce cations, Y cations, La cations, Eu cations, Gd cations, Nd cations;

provided that the first and second compositions are different; and provided that combinations that consist of two or more vanadates, borates, Ce cations, Y cations, La cations are excluded; and provided that if a first material is a silicate, then the second material is not a vanadate.

3. A method of coating a substrate, comprising exposing a substrate to at least one of the following binary combinations: sodium metavanadate and sodium metatungstate, sodium metavanadate and sodium metasilicate, sodium metavanadate and sodium phosphate, sodium metavanadate and sodium molybdate, barium metaborate and sodium metatungstate, barium metaborate and sodium metasilicate, cerium chloride and sodium metatungstate, yttrium chloride and sodium metatungstate, yttrium chloride and potassium phosphate, yttrium chloride and sodium phosphate, yttrium chloride and sodium metasilicate, yttrium chloride and sodium molybdate, europium chloride and sodium molybdate, gadolinium chloride and sodium molybdate, neodymium chloride and sodium molybdate, sodium metatungstate and potassium phosphate, sodium metatungstate and lanthanum chloride, sodium metatungstate and sodium metasilicate, sodium metatungstate and sodium molybdate, potassium phosphate and lanthanum chloride, potassium phosphate and sodium molybdate, lanthanum chloride and sodium metasilicate, lanthanum chloride and sodium phosphate, lanthanum chloride and sodium molybdate, sodium metasilicate and sodium phosphate, sodium metasilicate and sodium molybdate, sodium phosphate and sodium molybdate;

wherein said exposure includes introducing the substrate to the first member of the binary combination, followed by introducing the substrate to the second member of the binary combination.

* * * * *